US009522529B2

(12) United States Patent
Yamaguchi et al.

(10) Patent No.: US 9,522,529 B2
(45) Date of Patent: Dec. 20, 2016

(54) SUBSTRATE FOR LIQUID EJECTION HEAD, LIQUID EJECTION HEAD, AND APPARATUS AND METHOD FOR EJECTING LIQUID

(71) Applicant: CANON KABUSHIKI KAISHA, Tokyo (JP)

(72) Inventors: Takaaki Yamaguchi, Yokohama (JP); Toshio Negishi, Yokohama (JP); Taku Yokozawa, Yokohama (JP); Hiroaki Shirakawa, Kawasaki (JP); Kazunari Fujii, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/080,404

(22) Filed: Mar. 24, 2016

(65) Prior Publication Data

US 2016/0288494 A1 Oct. 6, 2016

(30) Foreign Application Priority Data

Mar. 30, 2015 (JP) ..... 2015-068760

(51) Int. Cl.
*B41J 29/38* (2006.01)
*B41J 2/045* (2006.01)

(52) U.S. Cl.
CPC ..... *B41J 2/04541* (2013.01); *B41J 2/0455* (2013.01); *B41J 2/0458* (2013.01); *B41J 2/04521* (2013.01); *B41J 2/04523* (2013.01); *B41J 2/04531* (2013.01); *B41J 2/04548* (2013.01)

(58) Field of Classification Search
CPC . B41J 2/04541; B41J 2/04521; B41J 2/04531; B41J 2/04523; B41J 2/0455; B41J 2/0458; B41J 2/04548
See application file for complete search history.

(56) References Cited

U.S. PATENT DOCUMENTS

2010/0134543 A1* 6/2010 Hirayama ..... B41J 2/04541 347/10
2011/0175959 A1* 7/2011 Van Brocklin ..... B41J 2/04541 347/14
2015/0283807 A1* 10/2015 Fujii ..... B41J 2/04541 347/54

FOREIGN PATENT DOCUMENTS

JP 2010-155452 A 7/2010

* cited by examiner

*Primary Examiner* — Julian Huffman
(74) *Attorney, Agent, or Firm* — Canon U.S.A. Inc., IP Division

(57) ABSTRACT

A substrate includes an AND circuit and an LVC. The AND circuit generates a control signal for switching an NMOS transistor. The LVC controls the gate voltage of the NMOS transistor on the basis of the control signal. The substrate applies a constant gate voltage to a PMOS transistor without using the AND circuit and the LVC.

19 Claims, 17 Drawing Sheets

SUBSTRATE FOR LIQUID EJECTION HEAD, LIQUID EJECTION HEAD, AND APPARATUS AND METHOD FOR EJECTING LIQUID

BACKGROUND OF THE INVENTION

Field of the Invention

The present invention relates to a substrate for a liquid ejection head for ejecting liquid, such as ink, the liquid ejection head, a liquid ejection apparatus, and a method for ejecting liquid.

Description of the Related Art

An example of the liquid ejection apparatus is an ink-jet printer that ejects liquid ink from a print head serving as a liquid ejection head to print an image. Such a printer ejects ink using ejection-energy generating elements, such as electro-thermal transducers (heaters) and piezoelectric elements. For example, with the heaters, the printer causes ink to generate bubbles using heat generated by the heaters and ejects the ink through ejection ports using the energy of generating bubbles.

Japanese Patent Laid-Open No. 2010-155452 discloses a configuration in which the gate voltage of a PMOS transistor connected to one end of each heater and the gate voltage of an NMOS transistor connected to the other end of the heater are individually controlled by individual voltage conversion circuits to stabilize a voltage for driving the heater. These voltage conversion circuits are installed in a print head substrate together with the PMOS transistors, the NMOS transistors, and the heaters.

The print head substrate described in Japanese Patent Laid-Open No. 2010-155452 includes a plurality of PMOS transistors and a plurality of NMOS transistors corresponding to the individual plurality of heaters. The print head substrate further includes a plurality of voltage conversion circuits corresponding to the plurality of PMOS transistors and a plurality of voltage conversion circuits corresponding to the plurality of NMOS transistors. However, to install the plurality of transistors and the plurality of voltage conversion circuits in the print head substrate, it is difficult to ensure a sufficient space therefor. For example, to dispose transistors and voltage conversion circuits between two arrays of heaters corresponding to two arrays of ejection ports requires a large distance between the two arrays of heaters, making it difficult to form the print head substrate within a desired size. Reducing the size of the transistors to form the print head substrate in a desired size can lead to severe limitation on the heater current because of the characteristics of the common-drain transistors and can reduce the voltage applied to the heaters, leading to a decrease in ink ejection efficiency.

SUMMARY OF THE INVENTION

The present invention provides a substrate for a liquid ejection head capable of ejecting liquid. The substrate is installed in the liquid ejection head. The substrate includes at least one liquid-ejection-energy generating element, first and second connecting units, at least one first transistor, at least one second transistor, at least one control circuit, and a supply circuit. The first and second connecting units are connectable to a first external power supply circuit. The at least one first transistor is connected between the first connecting unit and a first end of the liquid-ejection-energy generating element. The at least one second transistor is connected between the second connecting unit and a second end of the liquid-ejection-energy generating element. The at least one control circuit is configured to control a gate voltage of the first transistor to switch the first transistor. The supply circuit is configured to supply a constant gate voltage to the second transistor to constantly keep the second transistor at ON state. The control circuit controls the first transistor to switch so as to drive the liquid-ejection-energy generating element to an extent that the liquid is not ejected after the first and second connecting units are connected to the external power supply circuit and then the constant gate voltage is applied to the second transistor.

Further features of the present invention will become apparent from the following description of exemplary embodiments with reference to the attached drawings.

DESCRIPTION OF THE EMBODIMENTS

Figure 1:
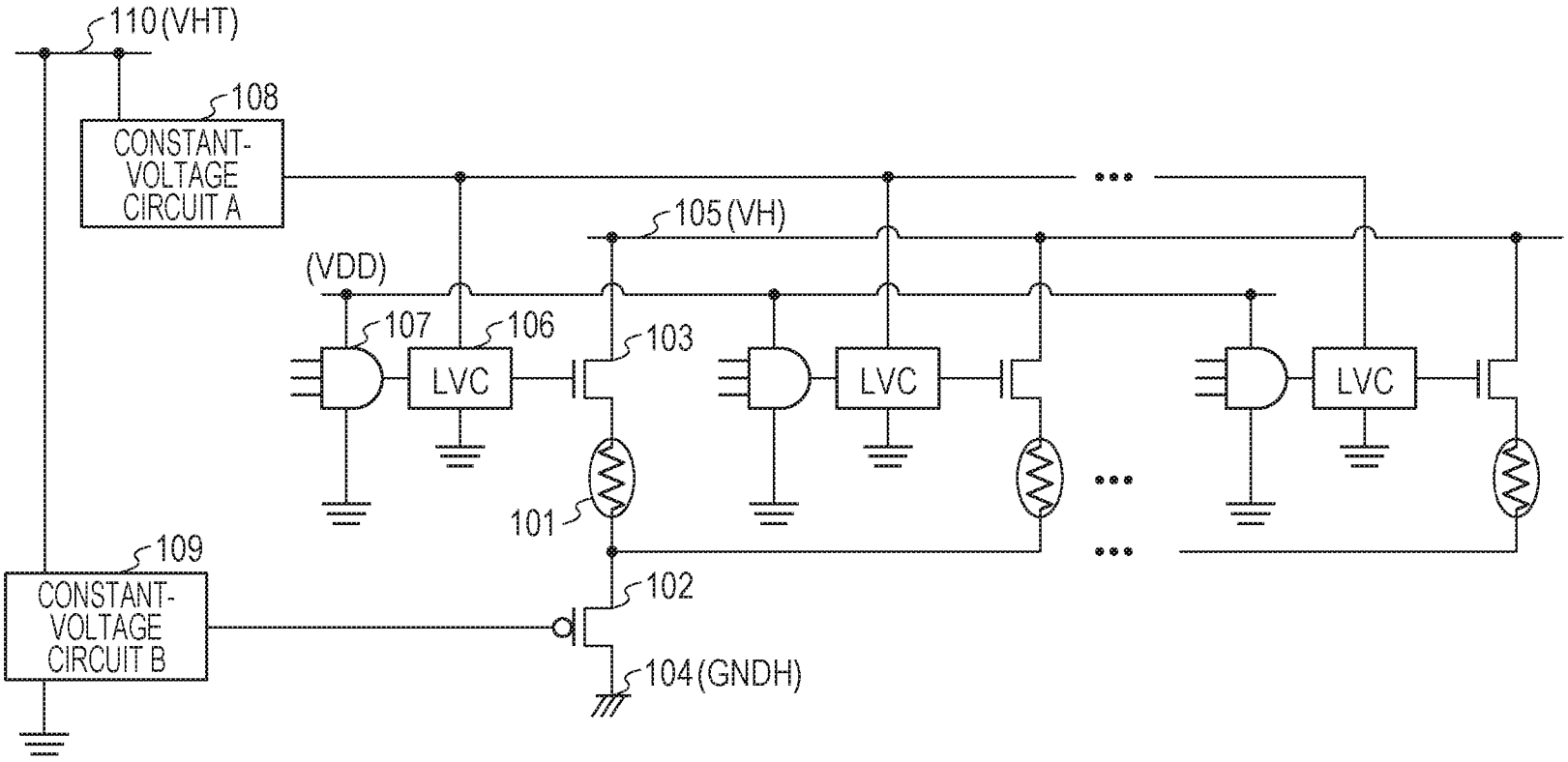
FIG. 1 is a circuit diagram of a substrate for a print head according to a first embodiment of the present invention.

Prior to descriptions of the embodiments of the present invention, the analysis of a circuit in which a transistor is connected to each end of each ejection-energy generating elements, such as heaters, to drive the ejection-energy generating elements will be described.

Suppose that for one of PMOS transistors and NMOS transistors in Japanese Patent Laid-Open No. 2010-155452, a voltage conversion circuit is disposed, and for the other transistor, no voltage conversion circuit is disposed, and simply a constant voltage is applied. In this case, the former transistor can be optionally switched by controlling gate voltage, and the latter transistor can be constantly kept at ON state. This configuration stabilizes heater driving voltage because of the presence of the latter transistor and simplifies the configuration of the print head substrate because of the absence of the voltage conversion circuit for the gate of the latter transistor.

For example, the gate voltage of the NMOS transistor is controlled using a voltage conversion circuit, and the gate of the PMOS transistor is subjected to a constant voltage at least during switching of the NMOS transistor. In this case, the gate of the NMOS transistor is subjected to a high voltage to apply a sufficient voltage to the heater. Let the heater driving voltage be VH, the gate voltage of the NMOS transistor be V(N)G, and the source voltage of the NMOS transistor be V(N)S. Assume that the heater driving voltage VH is applied after the source voltage V(N)S of the NMOS transistor is applied. In this case, the gate voltage V(N)G is not applied except when the heater is driven. However, if the gate voltage V(N)G is applied due to the influence of noise or trouble, the gate voltage V(N)G can become temporarily higher than the heater driving voltage VH before the heater driving voltage VH is applied. If the gate voltage V(N)G becomes higher than VH, the durability of the NMOS transistor can be decreased because of the high voltage of the gate of the NMOS transistor. In other words, for VGS (a gate-source withstand voltage), which is an important withstand pressure parameter of transistors, the source potential becomes significantly lower than the gate voltage, leading to a decrease in the durability of the NMOS transistor.

From this point of view, a desirable power supply sequence is applying the heater driving voltage VH and then applying the gate voltage V(N)G of the NMOS transistor. If only the heater driving voltage VH is applied, a minute leak current IDS flows between the drain and the source even if the NMOS transistor is at OFF state. In particular, for the PMOS transistor under a constant voltage, a phenomenon in which electrical charge is released before the heater is driven can occur. This phenomenon occurs because transistors are connected to both ends of the heater, and the potential of the heater cannot be fixed. If the heater is driven under such a phenomenon, electrical charges needs to be stored at the driver gate of the PMOS transistor at the same time a heater driving pulse is input. Although the time during which the electrical charges are stored is momentary, a large current flows through the gate wire when the heater is driven (turned on), and it takes much time to stabilize the operation. In particular, driving many heaters at the same time delays rising of current flowing through the heaters to delay the ejection timing of ink, leading to deviation of the landing positions of the ink.

Thus, providing no gate voltage conversion circuit at one of transistors connected both ends of the heater and simply applying a constant voltage thereto simplifies the configuration of the print head substrate while stabilizing the heater driving voltage. If in such a configuration a power supply timing for the heaters and the transistors is set, the rising of current flowing through the heaters can be delayed, and the ink ejection timing can be delayed.

The present invention is made based on such findings.

Embodiment of the present invention will be described hereinbelow with reference to the drawings. The liquid ejection heads of the following embodiments are applications of an ink-jet print head for use in ink-jet printing, in which an electro-thermal transducer (a heater) is used as an ejection-energy generating element for ejecting ink, which is liquid. The heater is also referred to as a printing element for ejecting ink to print an image. A power-supply wiring line for connecting the printing element to a power supply is referred to as VH wiring line, and a grounding wiring line for grounding the printing element is referred to as a GNDH wiring line. In the following embodiments, a plurality of heaters are disposed on a semiconductor substrate, and a driving logic circuit and power transistors for driving the plurality of heaters in response to external input signals are also disposed on the semiconductor substrate.

First Embodiment

An application of a liquid ejection apparatus according to a first embodiment of the present invention, that is, an ink-jet printer that ejects ink, will be described with reference to FIGS. 17A to 17C.

Figure 17A:
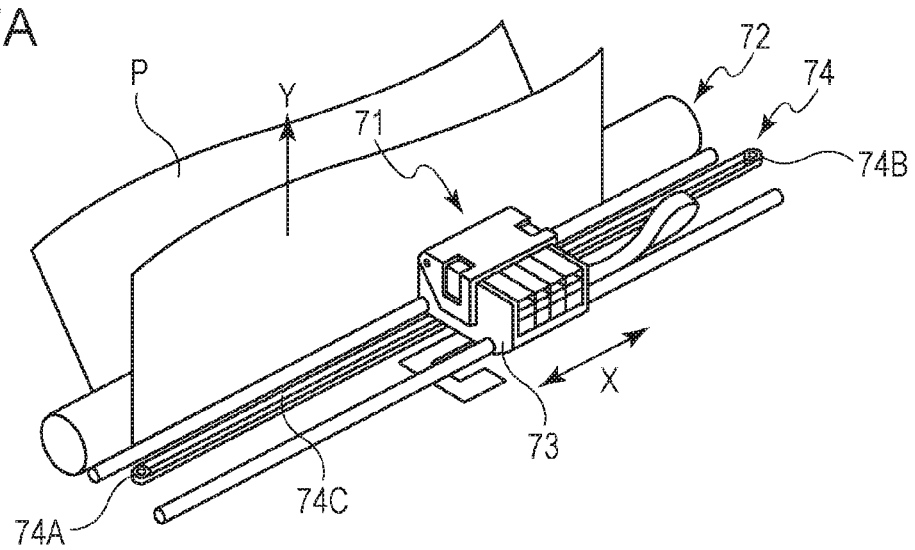
FIG. 17A is a diagram illustrating an ink-jet printer to which the embodiments of the present invention is applicable.

The ink-jet printer of this embodiment is a serial-scan printer and is configured as in FIG. 17A. The printer includes a moving mechanism 74 that moves a carriage 73, on which a print head 71 capable of ejecting ink can be mounted, in a main scanning direction indicated by an arrow X and a conveying mechanism 72 that conveys a printing medium P in a sub-scanning direction indicated by an arrow Y crossing (in this embodiment, perpendicular to) the main scanning direction. The moving mechanism 74 of this embodiment is configured to move the carriage 73 using a belt 74C stretched between pulleys 74A and 74B. By repeating a printing scan in which the print head 71 moves in the main scanning direction while ejecting ink and an operation of conveying the printing medium P in the sub-scanning direction, an image is formed on the printing medium P.

Figure 17B:
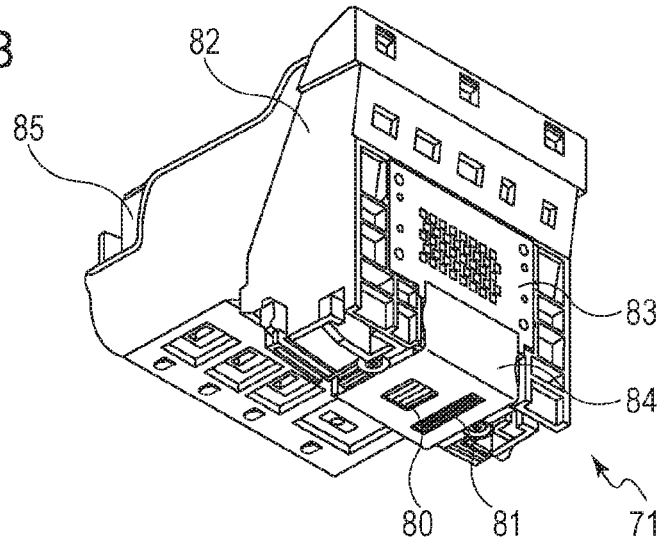
FIG. 17B is a diagram illustrating a print head to which the embodiments of the present invention is applicable.

As shown in FIG. 17B, a casing 82 of the print head 71 prepared in this embodiment is provided with a first electric wiring substrate 83, a second electric wiring substrate 84, and printing-element substrates 80 and 81. Furthermore, an ink tank 85 can be attached in the casing 82. Ink contained in the ink tank 85 is introduced into the printing-element substrates 80 and 81 through a channel in the casing 82.

Figure 17C:
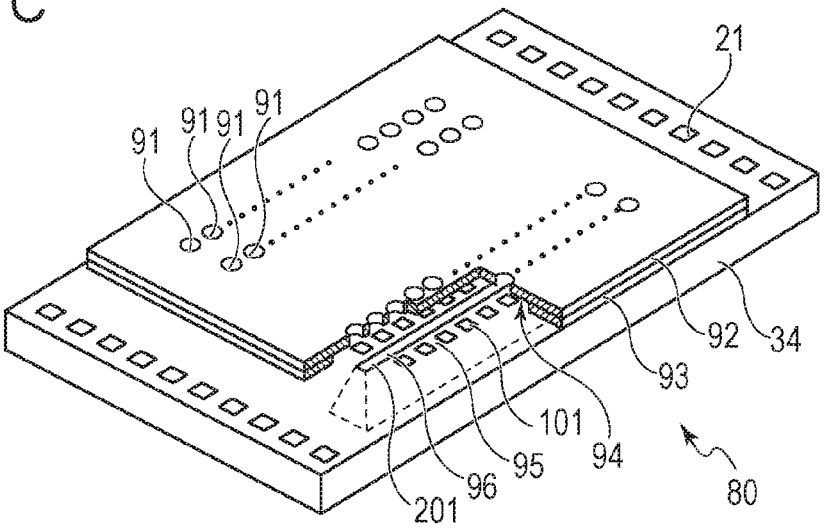
FIG. 17C is a diagram illustrating a print-head substrate to which the embodiments of the present invention is applicable.

FIG. 17C is a perspective view of the printing-element substrate 80 mounted on the print head 71. Electro-thermal transducers (heaters) 101 that generate energy for ejecting ink as a printing element are disposed on a semiconductor substrate 34 of the printing-element substrate 80. The heaters 101 are controlled by a control circuit (described later) disposed on the substrate (a substrate for the liquid ejection head) 34 under the control of a control unit of the printer.

The substrate 34 has a supply port 201 that can communicate with the ink tank (a liquid supply source) 85. A channel-formed member 93 and an ejection-port formed member 92 are disposed on the substrate 80. The channel-formed member 93 includes a foaming chamber 94 corresponding to the heaters 101, a liquid chamber 95 for introducing the ink into the foaming chamber 94 through the supply port 201, and a channel 96. The ejection-port formed member 92 has ejection ports 91 corresponding to the heaters 101. The printing-element substrate 80 also includes pads 21 for supplying voltage and signals to the printing-element substrate 80 from the outside. The pads 21 serve as connecting units connectable to the control unit of the printer and a power supply (a power supply circuit). By driving the heaters 101 to generate heat and cause the ink to generate bubbles in the foaming chamber 94 using the heat, the ink can be ejected through the ejection ports 91 using the bubble generating energy.

The substrate 34 includes heaters and a driving circuit including transistors for the individual heaters and a transistor common to the heaters, VH wiring lines, and GNDH wiring lines to constitute a print head substrate, as will be described later.

FIG. 1 is a diagram illustrating the substrate for an ink-jet print head (a semiconductor substrate) according to the first embodiment of the present invention, illustrating an equivalent circuit of a driving circuit for the electro-thermal transducers (heaters) serving as printing elements. The source of a PMOS transistor (a second transistor) 102 is coupled to one end of each heater 101, and the drain of the PMOS transistor 102 is coupled to a first power supply (GNDH) 104. The source of an NMOS transistor (a first transistor) 103 is coupled to the other end of the heater 101, and the drain of the NMOS transistor 103 is coupled to a second power supply (VH) 105. Thus, the PMOS transistor 102, the heaters 101, and the NMOS transistor 103 are connected in this sequence between the first power supply 104 and the second power supply 105. The gate of the NMOS transistor 103 connects to an LVC (a level converting circuit) 106 that converts the level of the gate voltage and an AND circuit 107 that selects the voltage level to be converted by the LVC 106. A constant voltage circuit A 108 and a constant voltage circuit B 109 are circuits that decrease the voltage of an external gate voltage supply 110 to generate a constant voltage. The levels of decreasing the voltage differ. The voltage output from the constant voltage circuit B 109 is lower than the voltage output from the constant voltage circuit A 108. The LVC 106 is subjected to the voltage decreased by the constant voltage circuit A 108. The constant voltage decreased by the constant voltage circuit B 109 is applied to the gate of the PMOS transistor 102 to constantly keep the PMOS transistor 102 at ON state. Thus, the constant voltage circuit B 109 serves as a supply circuit that supplies a constant gate voltage to constantly keep the PMOS transistor 102 at ON state.

The NMOS transistor 103 is disposed for each heater 101 in one-to-one correspondence, and the number of the NMOS transistors 103 is the same as the number of the heaters 101. In contrast, the number of the PMOS transistors 102 is smaller than the number of the heaters 101 and the total number of the NMOS transistors 103. In this embodiment, the transistors 103 are common-drain NMOS transistors, and the transistors 102 are common-drain PMOS transistors.

The AND circuit 107 generates a selecting signal (a control signal) for optionally switching the NMOS transistor 103. The LVC 106 changes the gate voltage of the NMOS transistor 103 in response to the selecting signal from the AND circuit 107. The AND circuit 107 and the LVC 106 constitute a control circuit for changing the gate voltage of the NMOS transistor 103. The AND circuit 107 functions as a generating unit that generates a control signal for switching the NMOS transistor 103. The LVC 106 functions as a voltage control unit that changes the gate voltage of the NMOS transistor 103 on the basis of the control signal. By controlling the gate voltage of the NMOS transistor 103 in response to the selecting signal from the AND circuit 107 in this manner, a current flowing through the heater 101, that is, ON and OFF of driving of the heater 101, can be controlled. The AND circuit 107 controls the gate voltage of the NMOS transistor 103 so that current does not flow through a plurality of heaters 101, at least a plurality of heaters 101 coupled in common to one PMOS transistor 102, at the same time. The circuit configuration for such control is a common configuration, and a description thereof will be omitted.

Figure 2:
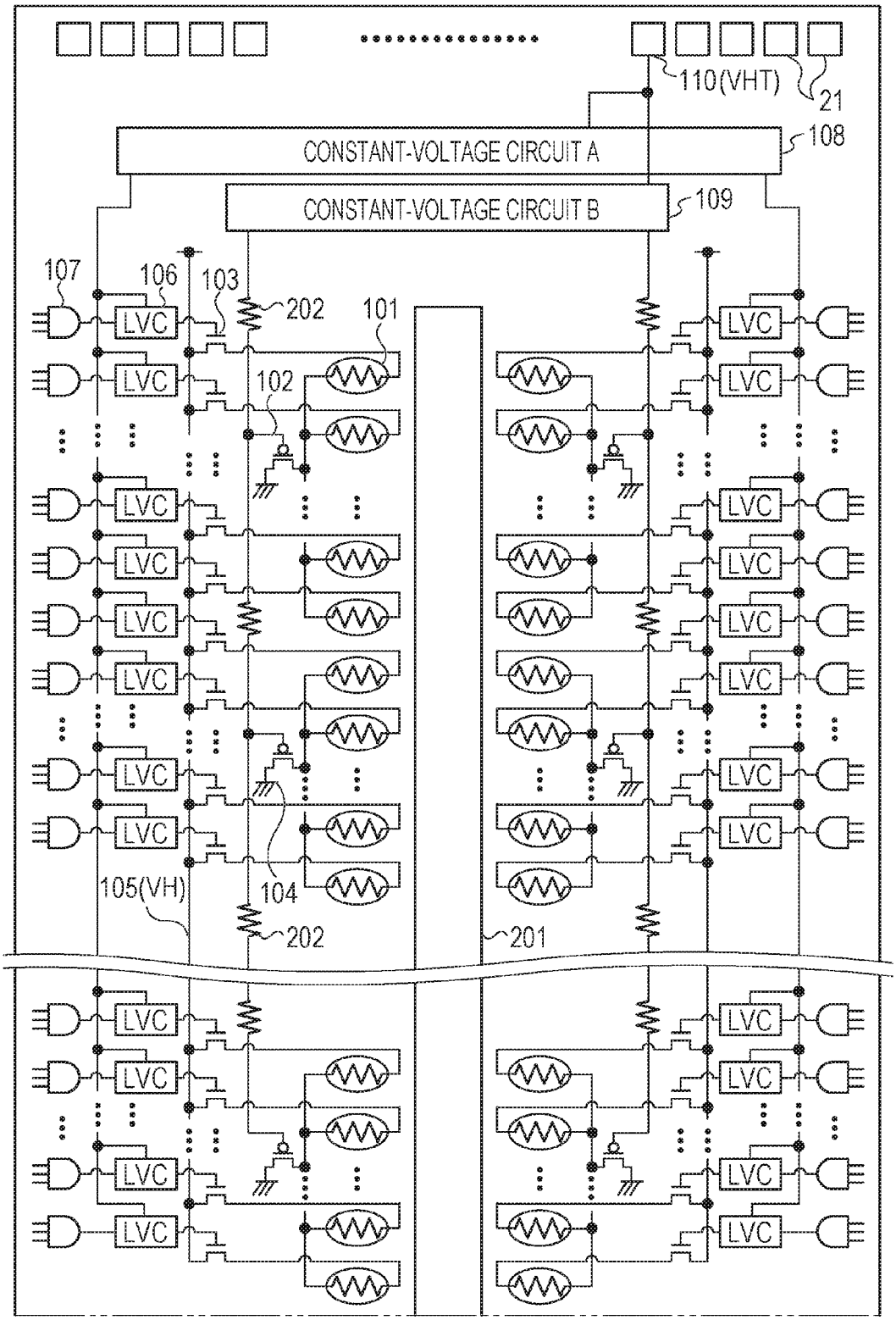
FIG. 2 is a diagram illustrating the arrangement of the components of the circuit in FIG. 1.

FIG. 2 is a diagram illustrating part of a substrate for an actual ink-jet print head on which the circuit in FIG. 1 is disposed. The reference signs and names in FIG. 2 are basically the same as those in FIG. 1. Since FIG. 2 illustrates the layout of an actual substrate, the ink supply port 201, which is a through-hole passing through the substrate, and parasitic resistors 202 each coupled from the constant voltage circuit B 109 to the gate of the PMOS transistor 102 are added. A direction in which the heaters 101 are arrayed (the vertical direction in FIG. 2) is a first direction, and a direction crossing the direction (in this embodiment, a lateral direction in FIG. 2 perpendicular to the first direction) is a second direction. The heaters 101, the PMOS transistors 102, and the NMOS transistors 103 are individually arrayed in the first direction. The arrays of the heaters 101, the arrays of the PMOS transistors 102, and the arrays of the NMOS transistors 103 are disposed at positions shifted in the second direction. The arrays of the heaters 101 are located nearer to the ink supply port 201 than the arrays of the PMOS transistors 102 and the arrays of the NMOS transistors 103 in the second direction. The heaters 101 and the PMOS transistors 102 are coupled at positions nearer to the ink supply port 201 than the NMOS transistors 103. The number of the NMOS transistors 103 is the same as the number of the heaters 101. The NMOS transistors 103 and the heaters 101 are coupled at position father away from the ink supply port 201 than the PMOS transistors 102.

Since the PMOS transistors 102 are each used in common to two or more heaters 101, the intervals between the PMOS transistors 102 in the first direction can be large. Thus, the interval between the PMOS transistors 102 in the first direction is larger than the interval between the NMOS transistors 103 in the first direction. Since the ink supply port 201 needs to be disposed near the heaters 101, an electric circuit including the PMOS transistors 102 and the NMOS transistors 103 is disposed at the opposite side from the ink supply port 201 with the heaters 101 therebetween. The first power supply (GNDH) 104 and the second power supply (VH) 105 are disposed in a wiring layer higher than the PMOS transistors 102 and the NMOS transistors 103 and are individually wired to the pads 21 at the upper part in FIG. 2.

The first power supply 104 is common to at least all of PMOS transistors 102 constituting one array. Specifically, the drains of the PMOS transistors 102 are coupled to a pad 21 corresponding to the first power supply 104 via a common wiring line (a first common wiring line). The second power supply 105 is common to at least all of NMOS transistors 103 constituting one array. Specifically, the drains of the NMOS transistors 103 are coupled to a pad 21 corresponding to the second power supply 105 via a common wiring line (a second common wiring line). The constant voltage circuit A 108 and the constant voltage circuit B 109 are disposed between the ink supply port 201 and the pads 21. Voltage applied to a pad corresponding to the gate voltage supply 110 is decreased by the constant voltage circuit A 108 and is applied to the LVCs 106, and is also decreased by the constant voltage circuit B 109 and is directly applied to the gates of the PMOS transistors 102.

Figure 3:
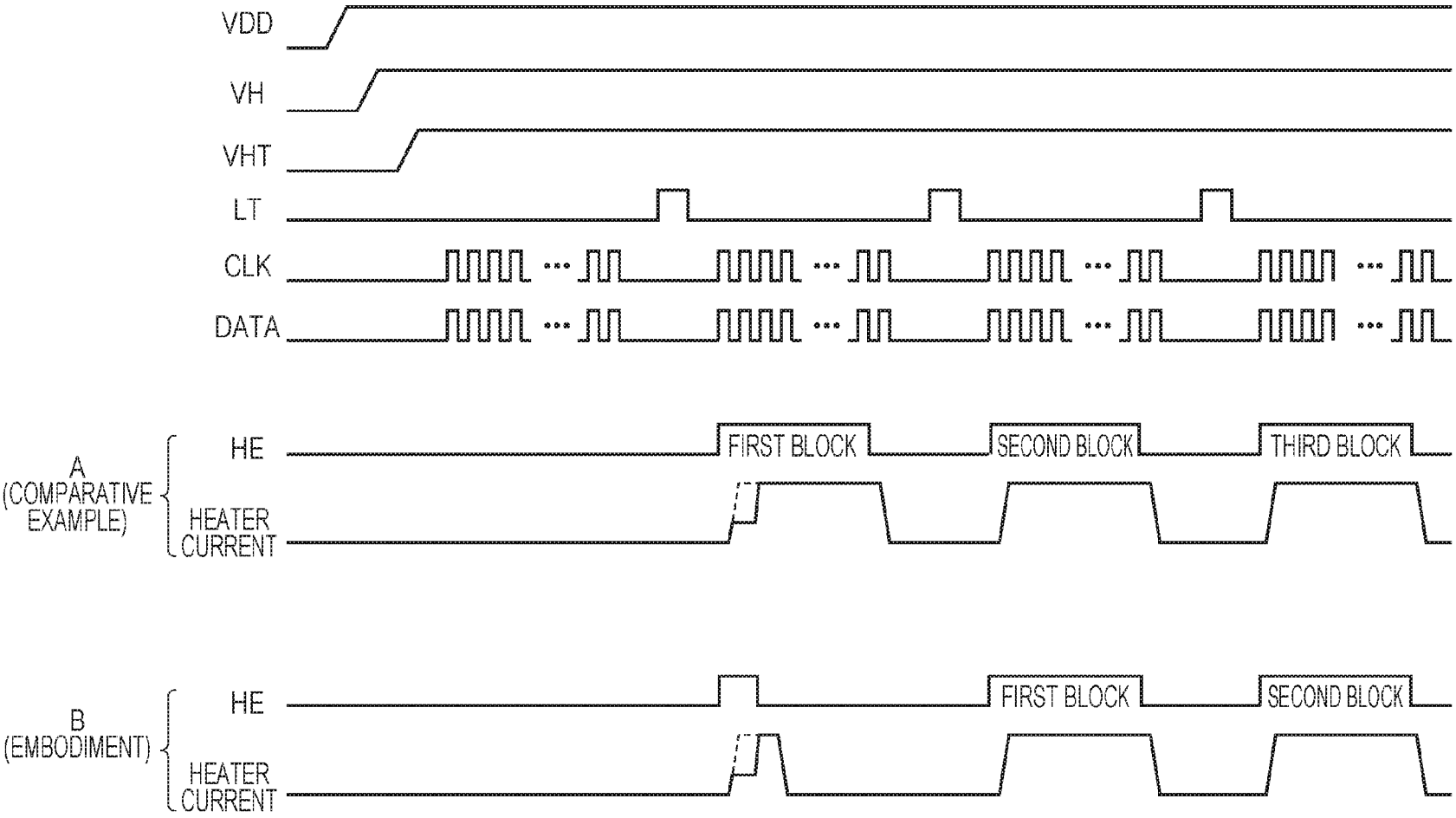
FIG. 3 is a time chart illustrating the operation of the circuit in FIG. 1.

FIG. 3 illustrates the relationship between application of a logic supply voltage VDD for the AND circuit 107 and so on, the second supply voltage (VH) 105, and the gate supply voltage (VHT) 110 and the sequence of driving.

First, after the logic supply voltage VDD is applied, the second supply voltage (VH) 105 is applied before application of the gate supply voltage VHT 110. This is for the purpose of providing a sufficient VGS (a gate-source withstand voltage), which is an important withstand voltage parameter of transistors, as described above. After the supply voltages VDD, VH, and VHT are applied, a CLK (clock) signal and a DATA (print data) signal for selectively driving the heaters 101 are input in synchronization with each other, and then heaters 101 to be driven are determined using a LT (latch) signal. Thereafter, the pulse width of a driving pulse for the heaters 101 is determined by a HE (heating enable) signal. The AND circuit 107 thus generates the control signals for optionally switching the NMOS transistors 103 in response to the DATA signal and so on. The LVCs 106 change the gate voltage so as to switch the NMOS transistors 103 on the basis of the control signals.

In a comparative example A in FIG. 3, after the CLK signal and the DATA signal are input, the LT signal is input, and a printing operation on the first block, described later, is performed in response to the HE signal input directly after the LT signal is input. In contrast, in this embodiment B, before starting of the printing operation on the first block after the supply voltage is applied, the NMOS transistor 103 is turned on so as to drive the heaters 101 to the extent that ink is not ejected, as in the embodiment B in FIG. 3. In other words, a driving pulse for driving the heaters 101 to the extent that ink is not ejected is applied to the gates of the NMOS transistors 103 by the LVCs 106 (a non-ejecting step). More specifically, the AND circuit 107 generates a short-pulse control signal in response to a (short pulse) HE signal with a shorter pulse width than that for ejecting ink to decrease the operating time of the heaters 101. The LVCs 106 apply gate voltage to the NMOS transistors 103 on the basis of the control signal. Such a short-pulse HE signal can be input from the control unit of the printer through the pad 21. The short-pulse HE signal is input once to the AND circuits 107 corresponding to all of the PMOS transistors 102 after the supply voltages VDD, VH, and VHT are applied. Thus, all of the PMOS transistors 102 become charged, and then a normal ink ejecting operation (an ejecting step) from the first block is performed. In this manner, a short-pulse HE signal at a level at which ink is not ejected from the ejection ports is input at least once before the HE signal for ejecting ink from the ejection ports for printing is input.

Figure 4:
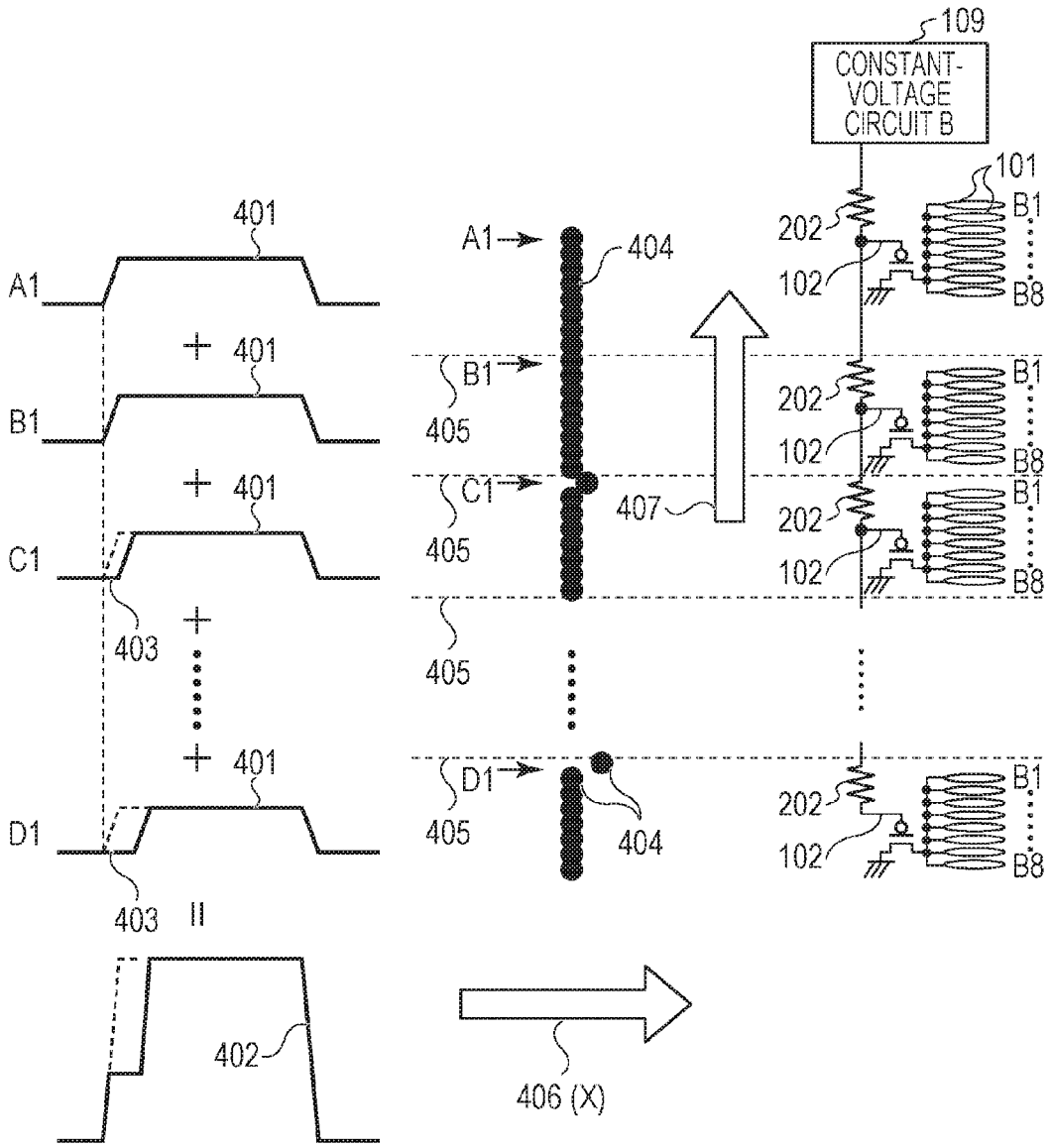
FIG. 4 is a diagram illustrating heater driving pulses in an comparative example.
Figure 5:
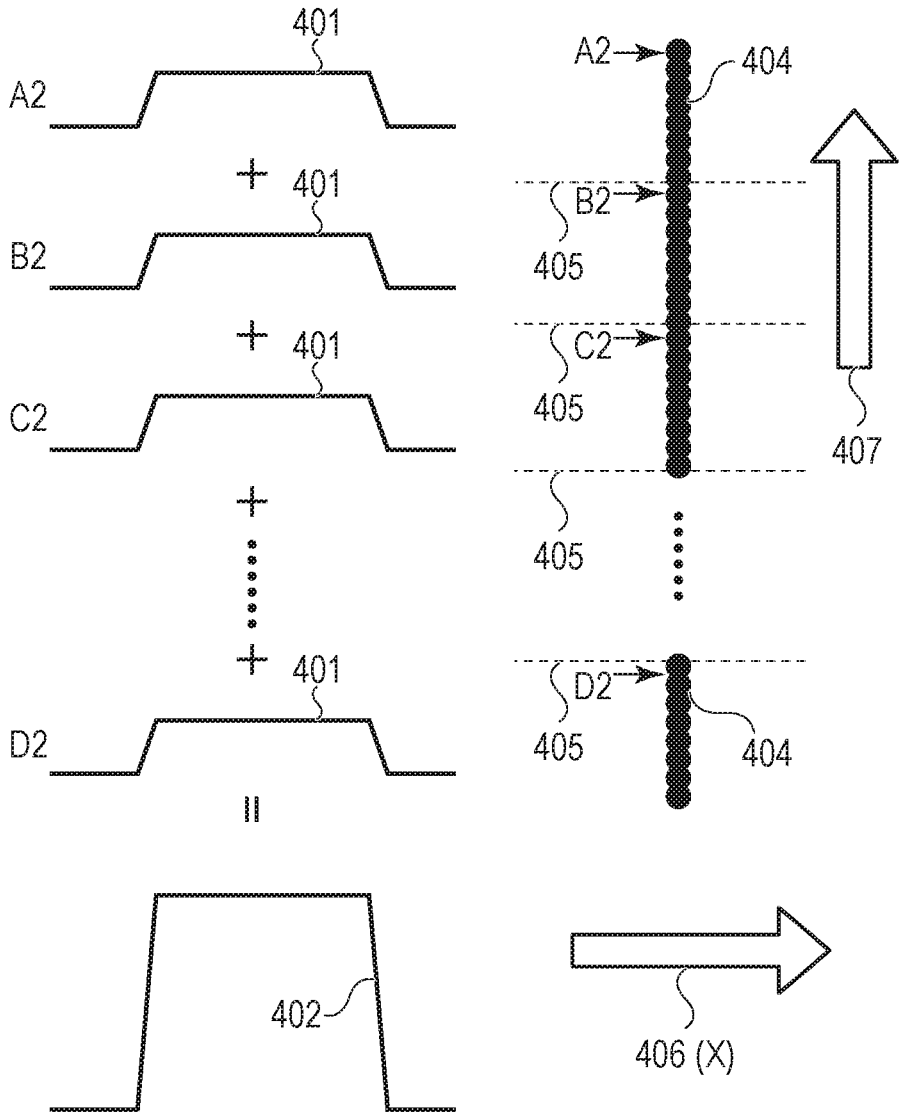
FIG. 5 is a diagram illustrating heater driving pulses in the first embodiment of the present invention.

FIG. 4 is a diagram illustrating the relationship between heater currents flowing through the plurality of heaters 101 of the first block in the driving sequence in the comparative example A in FIG. 3 and the landing positions of ink ejected when the heaters 101 are driven by the heater current. FIG. 5 is a diagram illustrating the relationship between heater currents flowing through the plurality of heaters 101 of the first block in the driving sequence in the embodiment B in FIG. 3 and the landing positions of ink ejected when the heaters 101 are driven by the heater current.

In the comparative example A of FIG. 4, the heaters 101 constituting one array is divided into eight blocks (B1 to B8), and the heaters 101 in one group of the eight blocks are coupled in common to one PMOS transistor 102. The heaters 101 are driven at shifted times in units of blocks (block-driven). In other words, the heaters 101 of the first block in each block are driven, and then the heaters 101 of the second block, the third block, . . . , and the eighth block are driven in sequence.

Waveforms A1, B1, C1, and D1 in FIG. 4 are the waveforms of heater currents 401 that flow when the heaters 101 of the first block (B1) are driven, and a waveform 402 is a total waveform of the waveforms A1, B1, C1, and D1. Points 403 are points at which the waveforms of the heater currents 401 are chipped to store electric charges in the PMOS transistors 102. Positions 404 are landing positions at which the ink ejected when the heaters 101 are driven lands, and positions 405 are boundary positions of the heaters 101 driven by one PMOS transistor 102. An arrow 406 indicates the scanning direction of the print head on which the heaters 101 are disposed (corresponding to arrow X in FIG. 17A), and an arrow 407 indicates a direction approaching the constant voltage circuit B 109.

In the comparative example A in FIG. 4, after application of the supply voltages VDD, VH, and VHT, an ink ejecting operation from the heaters 101 of the first block (B1) to the heaters 101 of the last block (in this example, the eighth block (B8)) is performed. In this case, the PMOS transistors 102 near the constant voltage circuit B 109 supplies normal heater currents 401, such as the waveforms A1 and B1, to the heaters 101 of the first block (B1). However, the PMOS transistors 102 far from the constant voltage circuit B 109 take much time for charging because of the presence of the parasitic resistor 202 between the PMOS transistors 102. This causes the PMOS transistors 102 far from the constant voltage circuit B 109 to supply heater currents 401 in which the rising edges of the waveforms are chipped, such as the waveforms C1 and D1, to the heaters 101 of the first block (B1).

The chipped points 403 of the waveforms C1 and D1 become large as the distance between the PMOS transistor 102 and the constant voltage circuit B 109 increases. The waveform 402, which is the total of the heater currents 401 for the heaters 101 of the first block (B1) generated by the PMOS transistors 102, is a waveform in which the rising edge is chipped.

In the comparative example A, the chipped points 403 of the waveforms C1 and D1 cause the ink landing positions 404 to deviate. In other words, the landing positions 404 can deviate in the scanning direction of the print head (arrow 406) after application of the supply voltages VDD, VH, and VHT to affect the print quality of the image.

In the embodiment B in FIG. 5, the heaters 101 are divided into eight blocks and are driven in units or blocks, as in the comparative example A in FIG. 4. However, in this embodiment, after application of the supply voltages VDD, VH, and VHT, the heaters 101 are supplied with current at a level at which ink is not ejected before starting of a printing operation on the first block (B1). The current causes all of the PMOS transistors 102 to be charged. Consequently, as in FIG. 5, all of the heaters 101 are supplied with the normal heater currents 401, such as waveforms A2, B2, C2, and D2, from the start of the following printing operation on the first block (B1). This allows printing of a high-quality image without causing deviation in landing positions of ejected ink corresponding to the first block (B1) in the scanning direction of the print head (in the direction of arrow 406).

Second Embodiment

Figure 6:
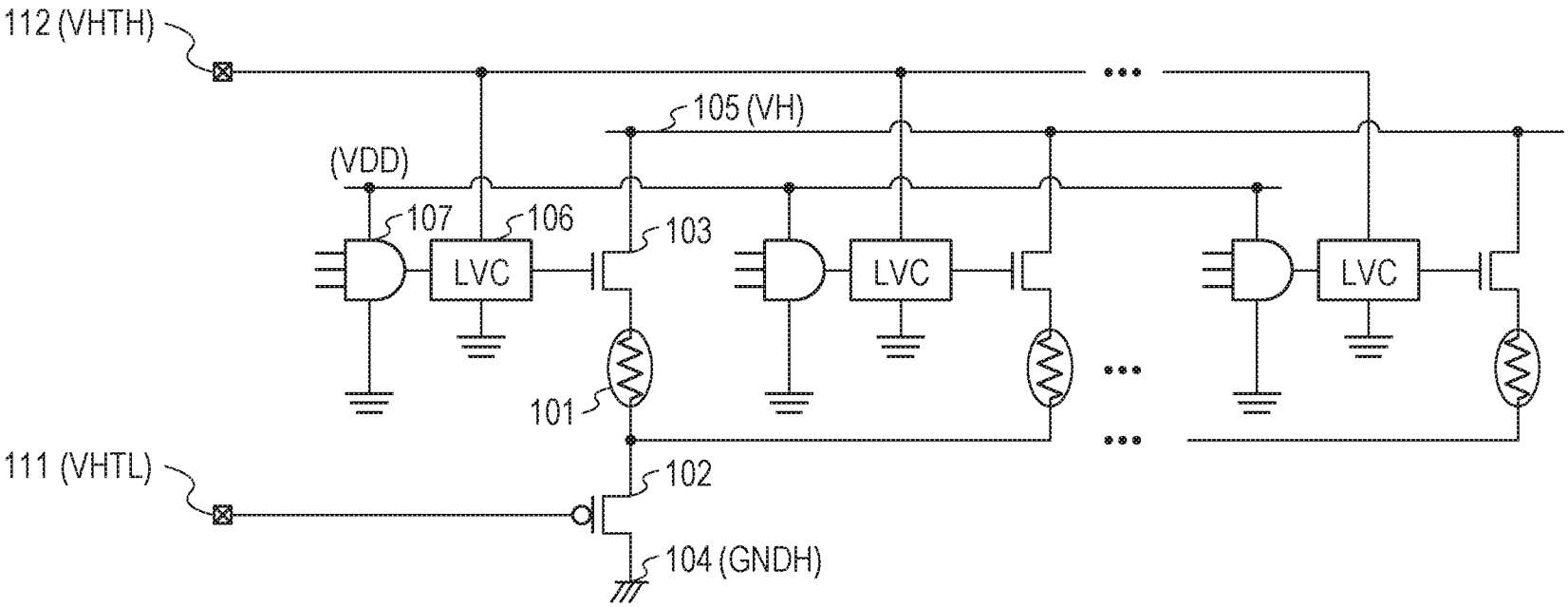
FIG. 6 is a circuit diagram of a substrate for a print head according to a second embodiment of the present invention.
Figure 7:
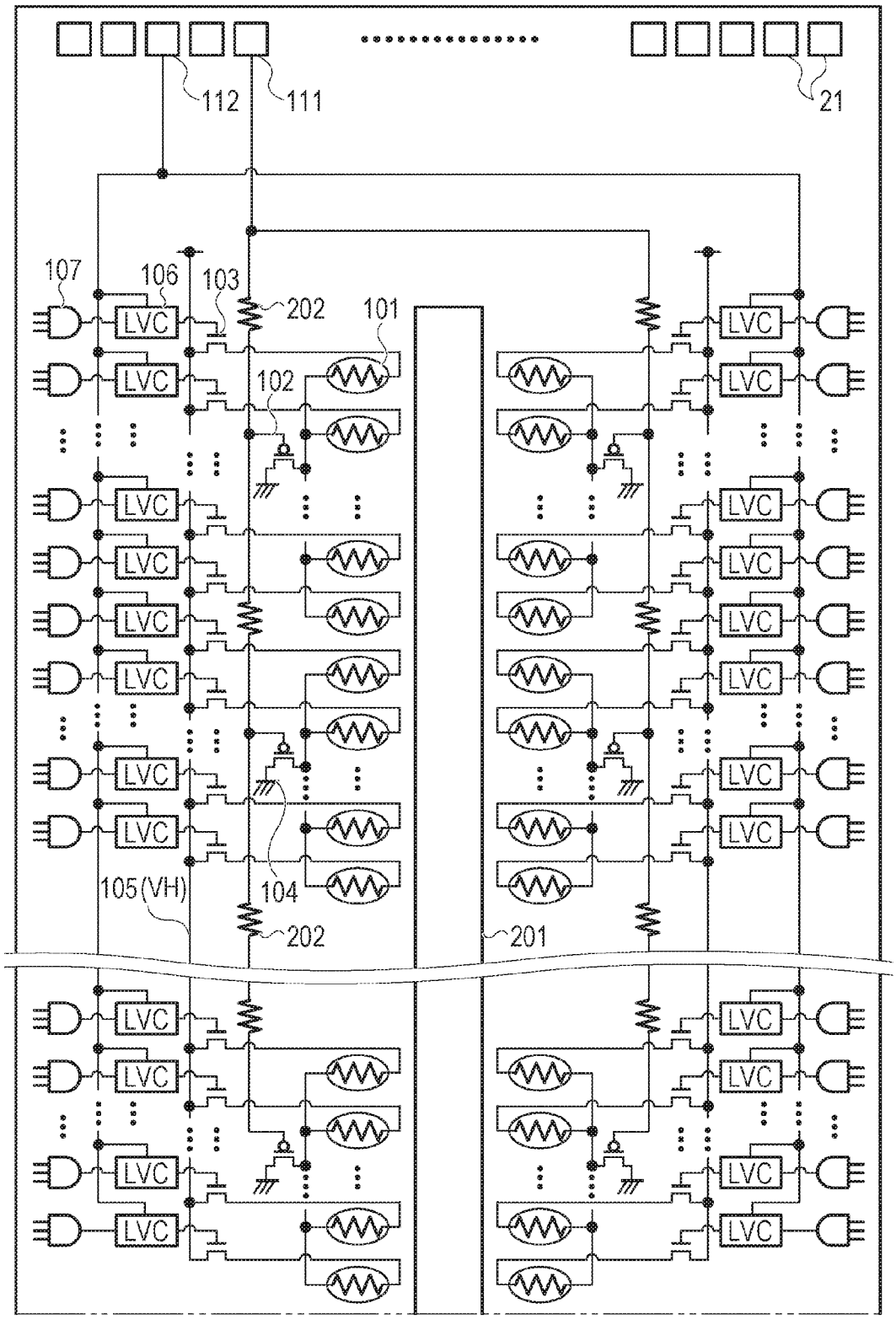
FIG. 7 is a diagram illustrating the arrangement of the components of the circuit in FIG. 6.
Figure 8:
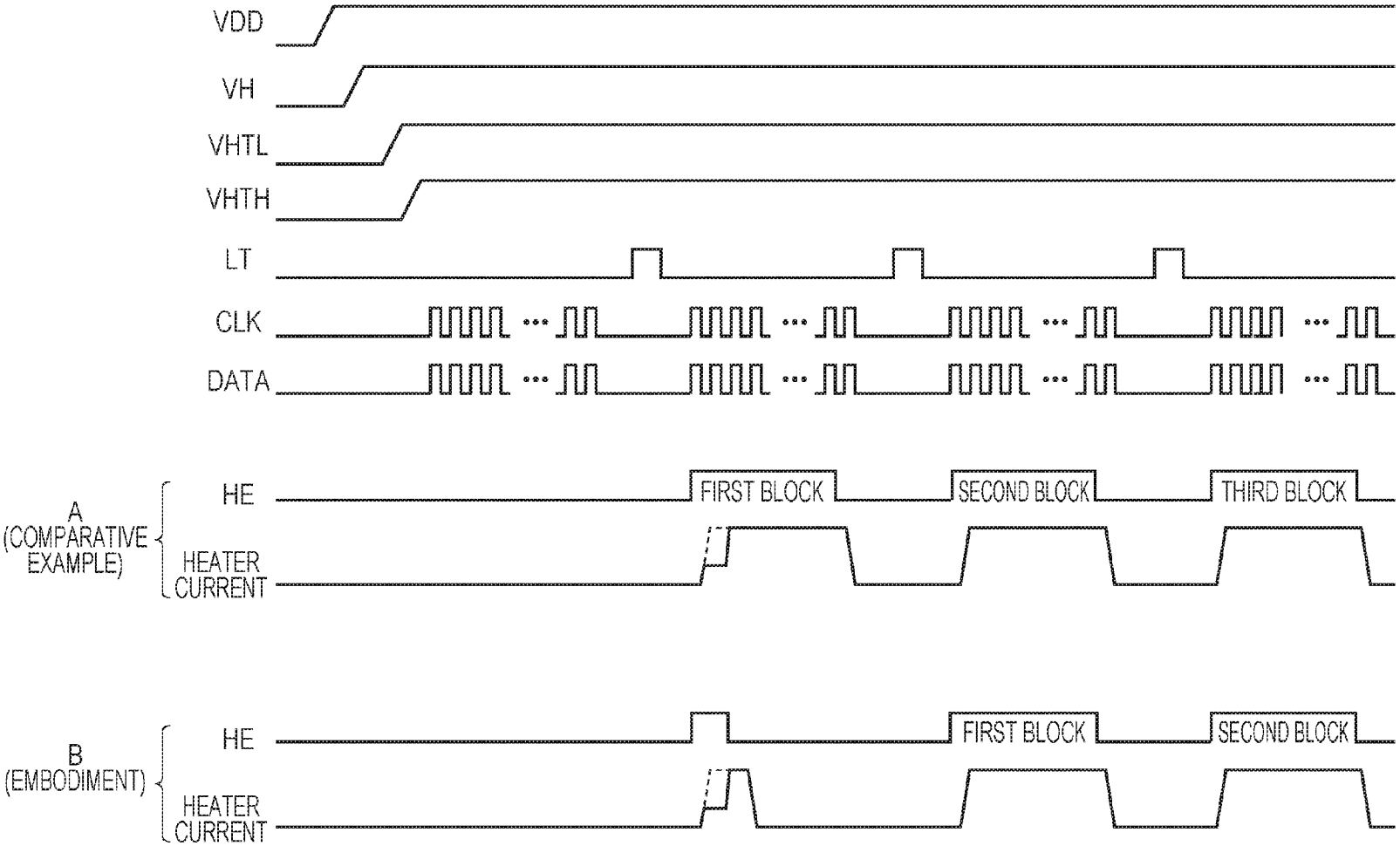
FIG. 8 is a time chart illustrating the operation of the circuit in FIG. 6.

FIGS. 6 to 8 are diagrams illustrating a second embodiment of the present invention. Descriptions of differences from the first embodiment will be given, and descriptions of commonalities will be omitted here.

In this embodiment, as shown in FIGS. 6 and 7, a given voltage VHTH is directly applied to the LVCs 106 via a pad 112, which is an electrical contact with the outside. Similarly, a given voltage VHTL is directly applied to the gates of the PMOS transistors 102 via a pad 111, which is an electrical contact with the outside. The voltages have the relation VHTH>VHTL. In this embodiment, as shown in FIG. 8, the logic supply voltage VDD, the second power supply (VH) 105, and the two gate supply voltages VHTL and VHTH are applied. In other words, after the logic supply voltage VDD is applied, the second power supply (VH) 105 is applied, and then the gate supply voltages VHTL and VHTH are applied. In this embodiment, after the voltage VHTL is applied, the voltage VHTH is applied. Alternatively, the order of application of the voltages VHTL and VHTH may be reversed. Application of the constant voltage VHTL to the gate of the PMOS transistor 102 constantly keeps the PMOS transistor 102 at ON state. Thus, the wiring line between the pad 111 and the PMOS transistor 102 constitutes a circuit that supplies a constant gate voltage to constantly keep the PMOS transistor 102 at ON state.

The relationship between the driving sequence of the comparative example A and the driving sequence of the embodiment B in FIG. 8 is the same as that of the first embodiment.

Third Embodiment

Figure 9:
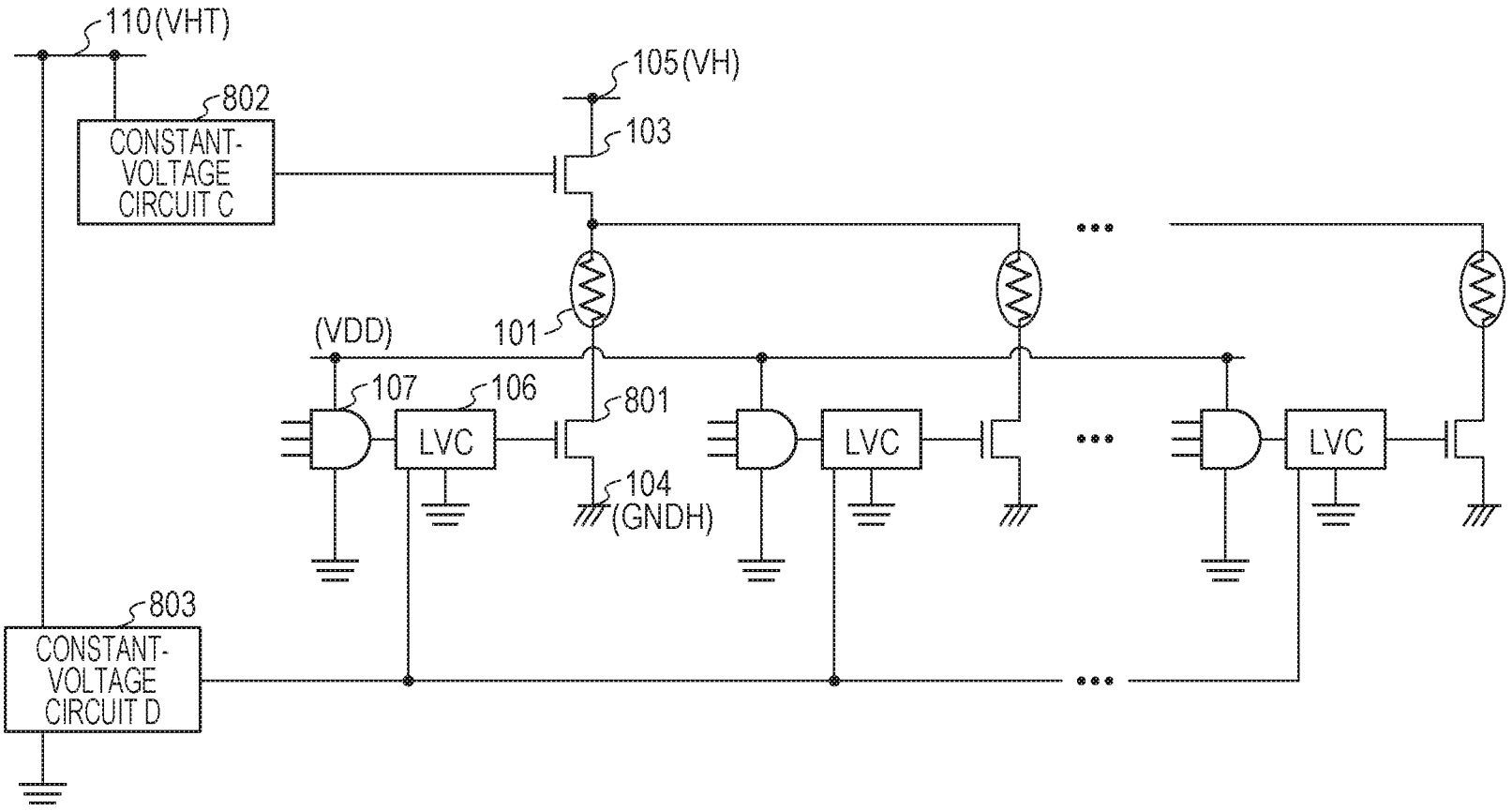
FIG. 9 is a circuit diagram of a substrate for a print head according to a third embodiment of the present invention.

FIG. 9 is a diagram illustrating a substrate for an ink-jet print head (a semiconductor substrate) according to a third embodiment of the present invention, illustrating an equivalent circuit of a driving circuit for electro-thermal transducers (heaters) serving as printing elements. The drain of an NMOS transistor (a first transistor) 801 is coupled to one end of each heater 101, and the source of the NMOS transistor 801 is coupled to a first power supply (GNDH) 104. The source of an NMOS transistor 103 is coupled to the other end of the heater 101, and the drain of the NMOS transistor 103 is coupled to a second power supply (VH) 105. The gate of the NMOS transistor 103 connects to an LVC (a level converting circuit) 106 that converts the level of the gate voltage and an AND circuit 107 that selects the voltage level to be converted by the LVC 106. A constant voltage circuit C 802 and a constant voltage circuit D 803 are circuits that decrease the voltage of a gate voltage supply 110 to generate a constant voltage. The levels of decreasing the voltage differ. The voltage output from the constant voltage circuit D 803 is lower than the voltage output from the constant voltage circuit C 802. The LVC 106 is subjected to the voltage decreased by the constant voltage circuit D 803. The constant voltage decreased by the constant voltage circuit C 802 is applied to the gate of the NMOS transistor 103.

The NMOS transistor 801 is disposed for each heater 101 in one-to-one correspondence, and the number of the NMOS transistors 801 is the same as the number of the heaters 101. In contrast, the number of the NMOS transistors 103 is smaller than the number of the heaters 101 and the total number of the NMOS transistors 801. In this embodiment, the transistors 103 are common-source NMOS transistors, and the transistors 801 are common-drain NMOS transistors.

An AND circuit 107 generates a selecting signal (a control signal) for optionally switching the NMOS transistor 801. The LVC 106 changes the gate voltage of the NMOS transistor 801 in response to the selecting signal from the AND circuit 107. By controlling the gate voltage of the NMOS transistor 801 in response to the selecting signal from the AND circuit 107 in this manner, a current flowing through the heater 101, that is, ON and OFF of driving of the heater 101, can be controlled. The AND circuit 107 controls the gate voltage of the NMOS transistor 801 so that current does not flow through a plurality of heaters 101, at least a plurality of heaters 101 coupled in common to one NMOS transistor 103, at the same time. The circuit configuration for such control is a common configuration, and a description thereof will be omitted.

Figure 10:
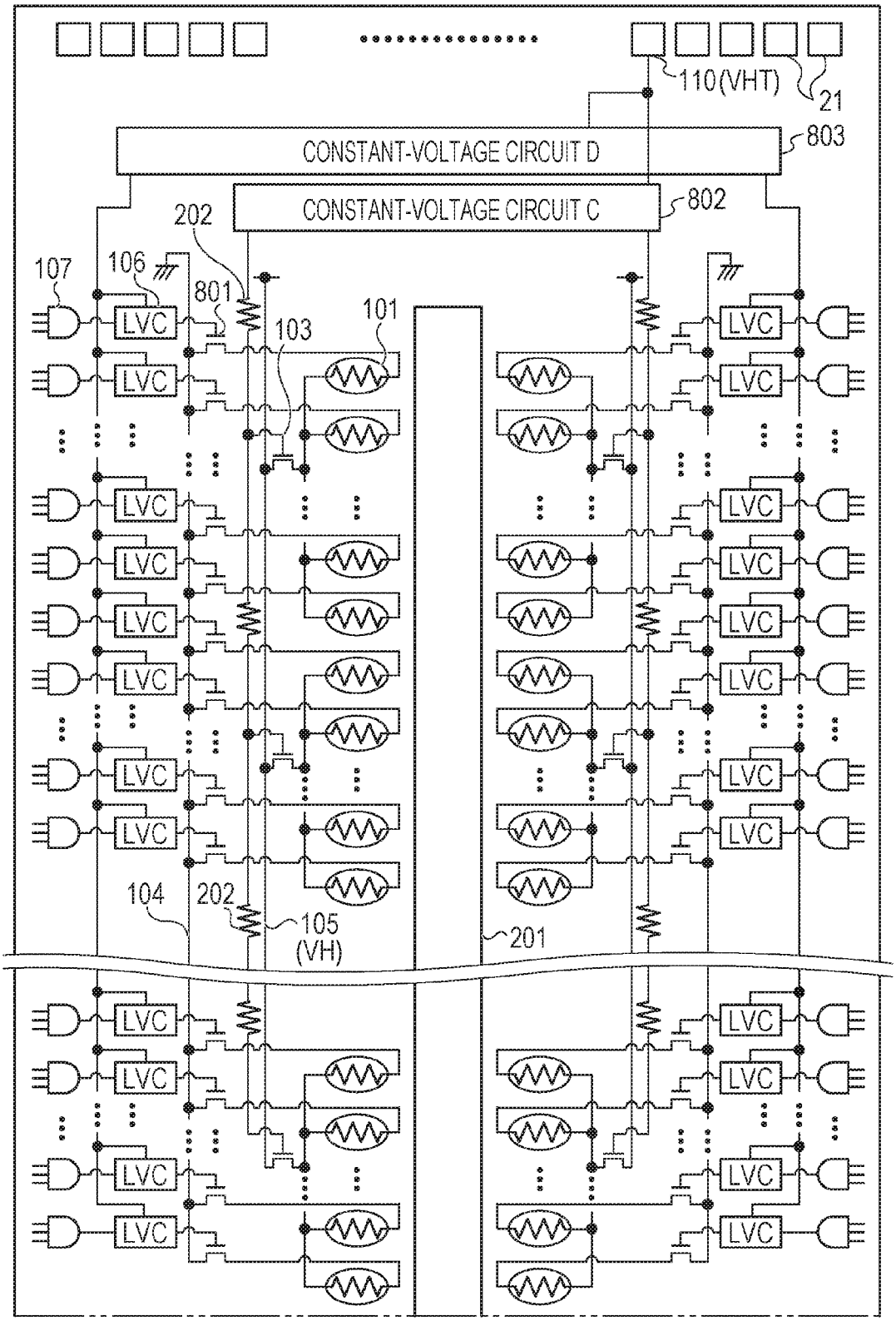
FIG. 10 is a diagram illustrating the arrangement of the components of the circuit in FIG. 9.

FIG. 10 is a diagram illustrating a substrate for an actual ink-jet head on which the circuit in FIG. 9 is disposed. The reference signs and names in FIG. 10 are basically the same as those in FIG. 9. Since FIG. 10 illustrates the layout of an actual substrate, an ink supply port 201 and parasitic resistors 202 each coupled from the constant voltage circuit C 802 to the gate of the NMOS transistor 103 are added. A direction in which the heaters 101 are arrayed (the vertical direction in FIG. 10) is a first direction, and a direction crossing the direction (in this embodiment, a lateral direction in FIG. 10 perpendicular to the first direction) is a second direction. The heaters 101, the NMOS transistors 103, and the NMOS transistors 801 are individually arrayed in the first direction. The arrays of the heaters 101, the arrays of the NMOS transistors 103, and the arrays of the NMOS transistors 801 are disposed at positions shifted in the second direction. The arrays of the heaters 101 are located nearer to the ink supply port 201 than the arrays of the NMOS transistors 103 and the arrays of the NMOS transistors 801 in the second direction. The heaters 101 and the NMOS transistors 103 are coupled at positions nearer to the ink supply port 201 than the NMOS transistor 801. The number of the NMOS transistors 801 is the same as the number of the heaters 101. The NMOS transistors 801 and the heaters 101 are coupled at position father away from the ink supply port 201 than the NMOS transistors 103.

Since the NMOS transistors 103 are each used in common to a plurality of heaters 101, the intervals between the NMOS transistors 103 in the first direction can be large. Thus, the interval between the NMOS transistors 103 in the first direction is larger than the interval between the NMOS transistors 801 in the first direction. Since the ink supply port 201 needs to be disposed near the heaters 101, an electric circuit including the NMOS transistors 103 and the NMOS transistors 801 is disposed at the opposite side from the ink supply port 201 with the heaters 101 therebetween. The first power supply (GNDH) 104 and the second power supply (VH) 105 are disposed in a wiring layer higher than the NMOS transistors 103 and the NMOS transistors 801 and are individually wired to pads 21 at the upper part in FIG. 10.

The first power supply (GNDH) 104 may be coupled to the pad 21 corresponding to the first power supply 104 via a wiring line (a common wiring line) common to the plurality of NMOS transistors 801 or via wiring lines (individual wiring lines) for the NMOS transistors 801 that are turned on at the same time. The second power supply 105 is common to all of NMOS transistors 103 constituting at least one array. Specifically, the drains of the NMOS transistors 103 are coupled to a pad 21 corresponding to the second power supply 105 via a common wiring line (a second common wiring line). The constant voltage circuit C 802 and the constant voltage circuit D 803 are disposed between the ink supply port 201 and the pads 21. Voltage applied to a pad connected to the gate voltage supply 110 is decreased by the constant voltage circuit D 803 and is applied to the LVCs 106, and is also decreased by the constant voltage circuit C 802 and is directly applied to the gates of the NMOS transistors 103.

The relationship between application of the logic supply voltage VDD, the second supply voltage (VH) 105, and the gate supply voltage (VHT) 110 and the sequence of driving is the same as those in FIGS. 3 to 5 in the first embodiment, a description thereof will be omitted.

Fourth Embodiment

Figure 11:
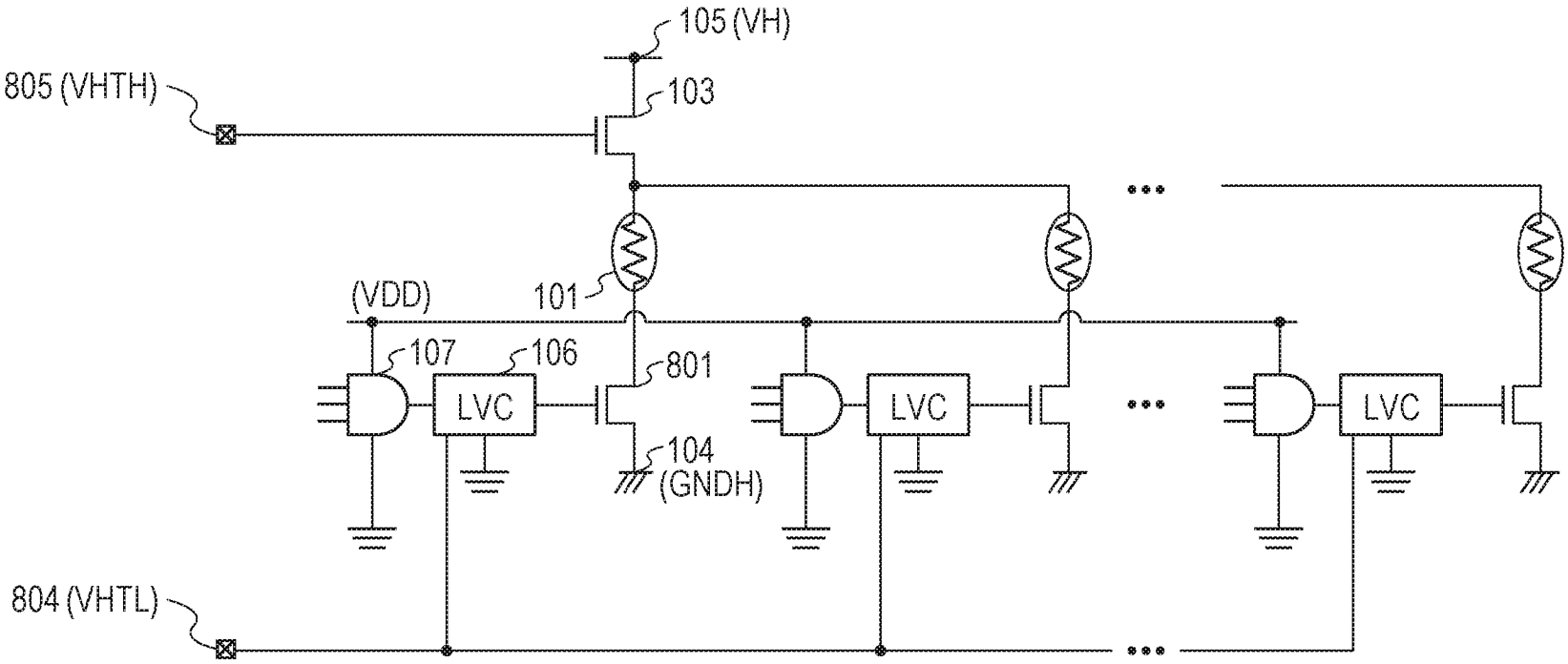
FIG. 11 is a circuit diagram of a substrate for a print head according to a fourth embodiment of the present invention.
Figure 12:
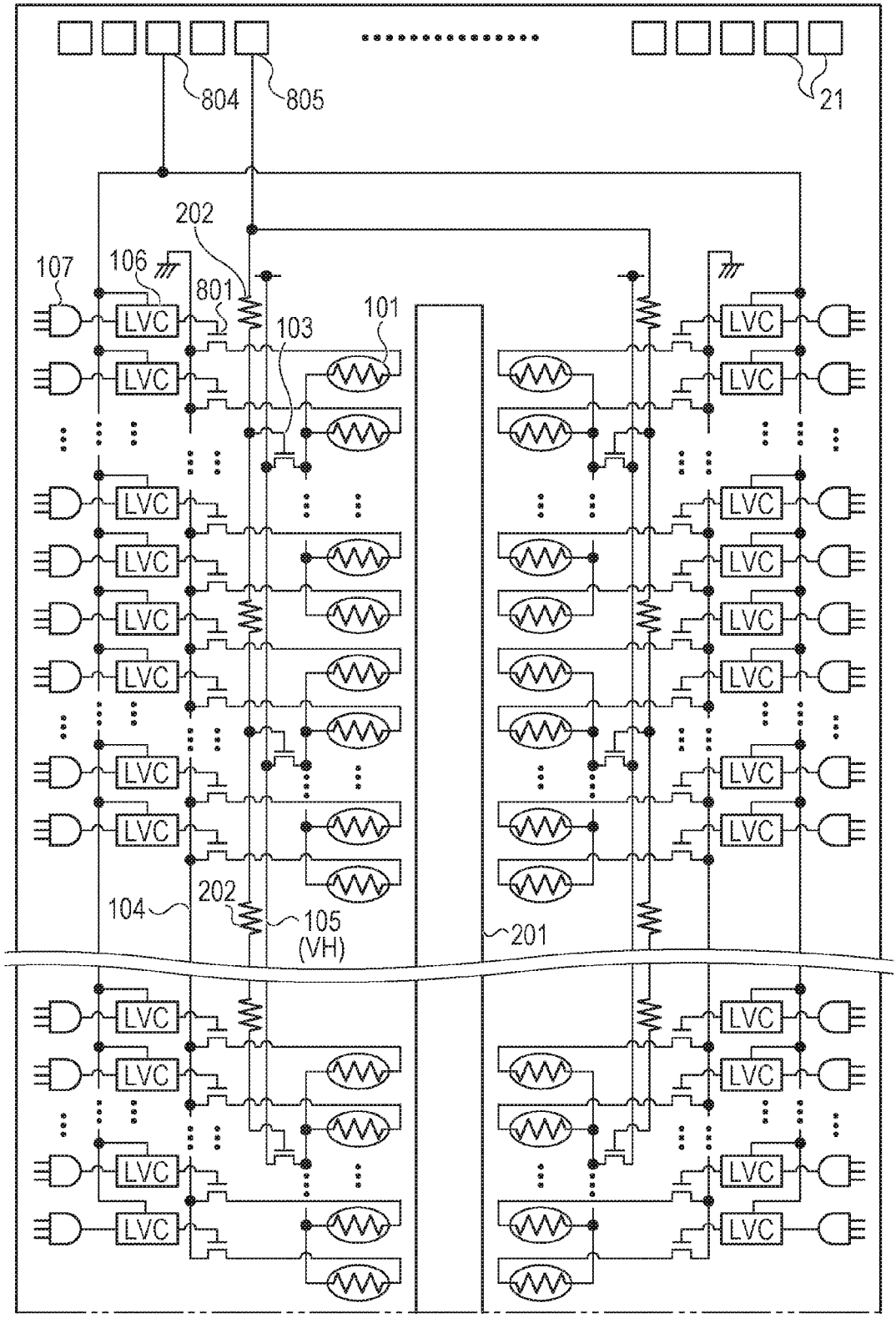
FIG. 12 is a diagram illustrating the arrangement of the components of the circuit in FIG. 11.

FIGS. 11 and 12 are diagrams illustrating a fourth embodiment of the present invention. Descriptions of differences from the third embodiment will be given, and descriptions of commonalities will be omitted here.

In this embodiment, as shown in FIGS. 11 and 12, a given voltage VHTL is directly applied to the LVCs 106 via a pad 804, which is an electrical contact with the outside. Similarly, a given voltage VHTH is directly applied to the gates of the NMOS transistors 103 via a pad 805, which is an electrical contact with the outside. The voltages have the relation VHTH>VHTL.

The relationship between application of the logic supply voltage VDD, the second supply voltage (VH) 105, and the gate supply voltage (VHT) 110 and the sequence of driving is the same as those in FIGS. 3 to 5 in the first embodiment, a description thereof will be omitted.

Fifth Embodiment

Figure 13:
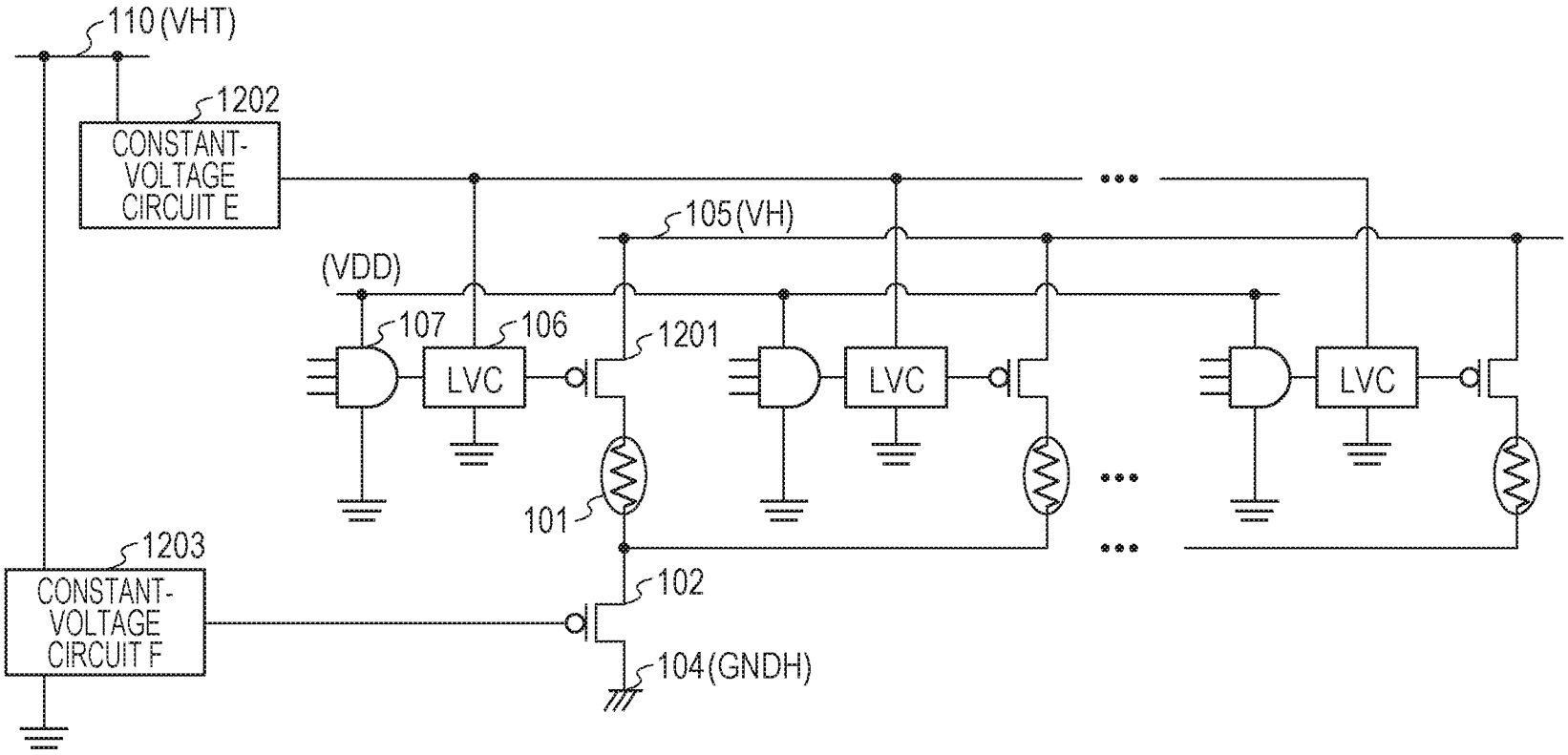
FIG. 13 is a circuit diagram of a substrate for a print head according to a fifth embodiment of the present invention.

FIG. 13 is a diagram illustrating a substrate for an ink-jet print head (a semiconductor substrate) according to a fifth embodiment of the present invention, illustrating an equivalent circuit of a driving circuit for electro-thermal transducers (heaters) serving as printing elements. The source of a PMOS transistor (a second transistor) 102 is coupled to one end of each heater 101, and the drain of the PMOS transistor 102 is coupled to a first power supply (GNDH) 104. The drain of a PMOS transistor (a first transistor) 1201 is coupled to the other end of the heater 101, and the source of the PMOS transistor 1201 is coupled to a second power supply (VH) 105. The gate of the PMOS transistor 1201 connects to an LVC (a level converting circuit) 106 that converts the level of the gate voltage and an AND circuit 107 that selects the voltage level to be converted by the LVC 106. A constant voltage circuit E 1202 and a constant voltage circuit F 1203 are circuits that decrease the voltage of an external gate voltage supply 110 to generate a constant voltage. The levels of decreasing the voltage differ. The voltage output from the constant voltage circuit F 1203 is lower than the voltage output from the constant voltage circuit E 1202. The LVC 106 is subjected to the voltage decreased by the constant voltage circuit E 1202. The voltage decreased by the constant voltage circuit F 1203 is applied to the gate of the PMOS transistor 102.

The PMOS transistor 1201 is disposed for each heater 101 in one-to-one correspondence, and the number of the PMOS transistors 1201 is the same as the number of the heaters 101. In contrast, the number of the PMOS transistors 102 is smaller than the number of the heaters 101 and the total number of the PMOS transistors 1201. In this embodiment, the transistors 102 are common-drain PMOS transistors, and the transistors 1201 are common-source PMOS transistors.

An AND circuit 107 generates a selecting signal (a control signal) for optionally switching the PMOS transistor 1201. The LVC 106 changes the gate voltage of the PMOS transistor 1201 in response to the selecting signal from the AND circuit 107. By controlling the gate voltage of the PMOS transistor 1201 in response to the selecting signal from the AND circuit 107 in this manner, a current flowing through the heater 101, that is, ON and OFF of driving of the heater 101, can be controlled. The AND circuit 107 controls the gate voltage of the PMOS transistor 1201 so that current does not flow through a plurality of heaters 101, at least a plurality of heaters 101 coupled in common to one PMOS transistor 102, at the same time. The circuit configuration for such control is a common configuration, and a description thereof will be omitted.

Figure 14:
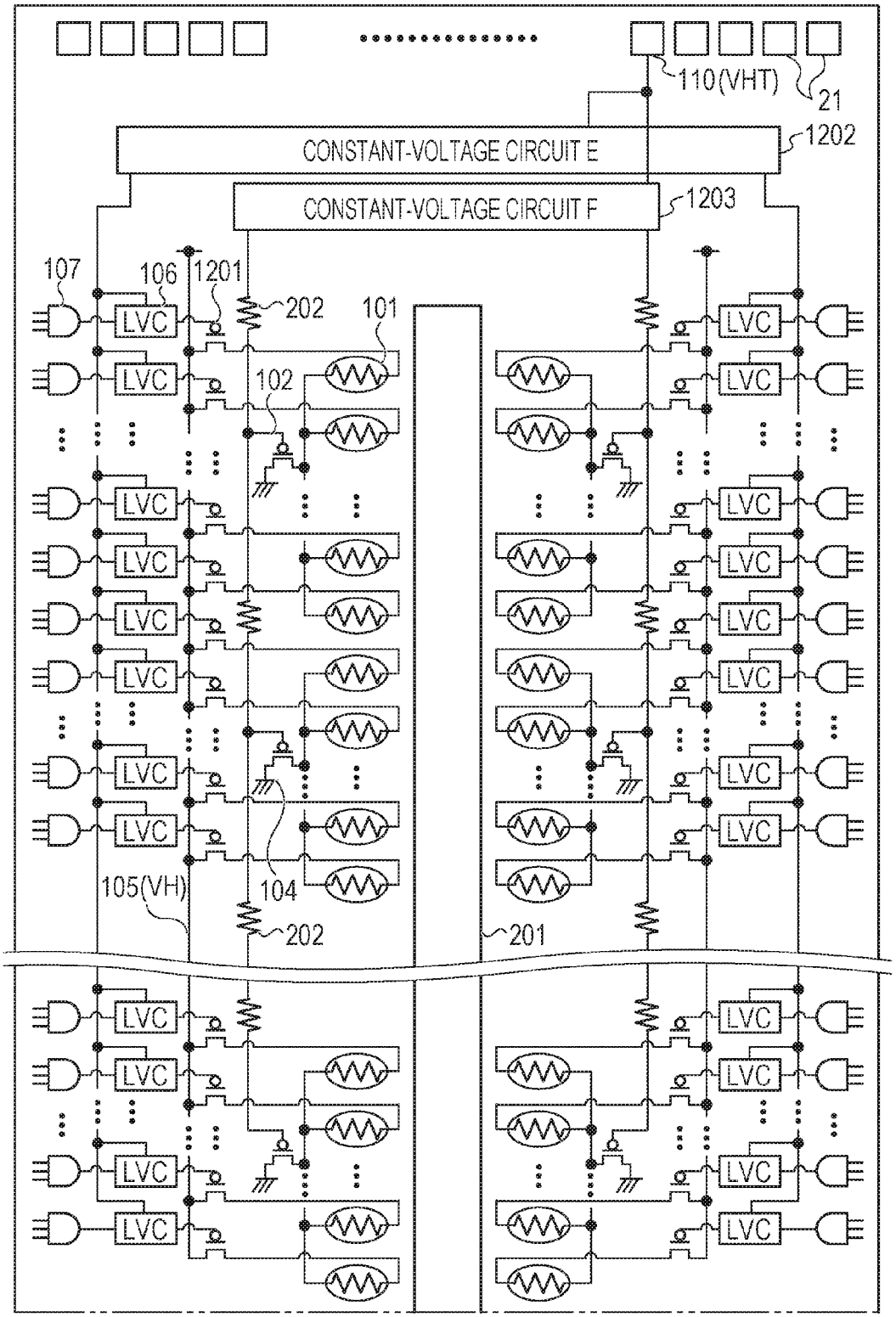
FIG. 14 is a diagram illustrating the arrangement of the components of the circuit in FIG. 13.

FIG. 14 is a diagram illustrating a substrate for an actual ink-jet print head on which the circuit in FIG. 13 is disposed. The reference signs and names in FIG. 14 are basically the same as those in FIG. 13. Since FIG. 14 illustrates the layout of an actual substrate, an ink supply port 201 and parasitic resistors 202 each coupled from the constant voltage circuit F 1203 to the gate of the PMOS transistor 102 are added. A direction in which the heaters 101 are arrayed (the vertical direction in FIG. 14) is a first direction, and a direction crossing the direction (in this embodiment, a lateral direction in FIG. 14 perpendicular to the first direction) is a second direction. The heaters 101, the PMOS transistors 102, and the PMOS transistors 1201 are individually arrayed in the first direction. The arrays of the heaters 101, the arrays of the PMOS transistors 102, and the arrays of the PMOS transistors 1201 are disposed at positions shifted in the second direction. The arrays of the heaters 101 are located nearer to the ink supply port 201 than the arrays of the PMOS transistors 102 and the arrays of the PMOS transistors 1201 in the second direction. The heaters 101 and the PMOS transistors 102 are coupled at positions nearer to the ink supply port 201 than the PMOS transistors 1201. The number of the PMOS transistors 1201 is the same as the number of the heaters 101. The PMOS transistors 1201 and the heaters 101 are coupled at position father away from the ink supply port 201 than the PMOS transistors 102.

Since the PMOS transistors 102 are each used in common to a plurality of heaters 101, the intervals between the PMOS transistors 102 in the first direction can be large. Thus, the interval between the PMOS transistors 102 in the first direction is larger than the interval between the PMOS transistors 1201 in the first direction. Since the ink supply port 201 needs to be disposed near the heaters 101, an electric circuit including the PMOS transistors 102 and the PMOS transistors 1201 is disposed at the opposite side from the ink supply port 201 with the heaters 101 therebetween. The first power supply (GNDH) 104 and the second power supply (VH) 105 are disposed in a wiring layer higher than the PMOS transistors 102 and the PMOS transistors 1201 and are individually wired to pads 21 at the upper part in FIG. 14. The constant voltage circuit E 1202 and the constant voltage circuit F 1203 are disposed between the ink supply port 201 and the pads 21. Voltage applied to a pad corresponding to the gate voltage supply 110 is decreased by the constant voltage circuit E 1203 and is applied to the LVCs 106, and is also decreased by the constant voltage circuit F 1202 and is directly applied to the gates of the PMOS transistors 102.

The relationship between application of the logic supply voltage VDD, the second supply voltage (VH) 105, and the gate supply voltage (VHT) 110 and the sequence of driving is the same as those in FIGS. 3 to 5 in the first embodiment, a description thereof will be omitted.

Sixth Embodiment

Figure 15:
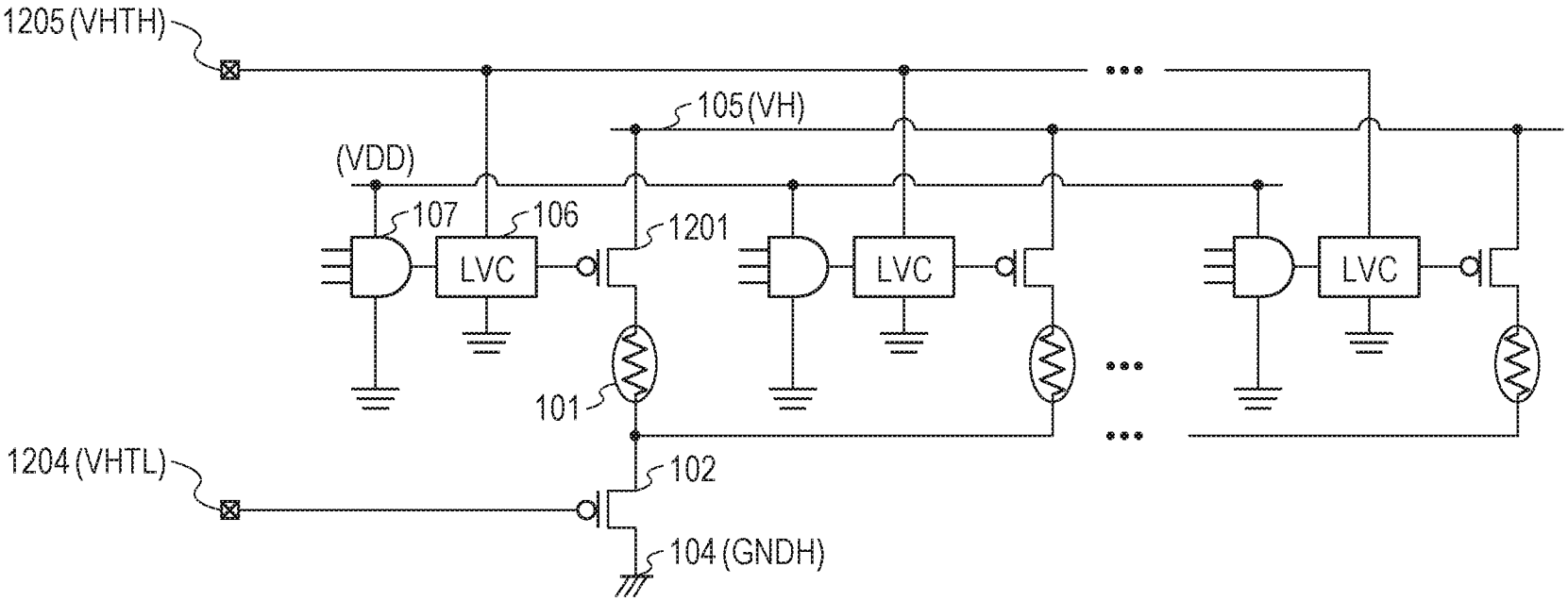
FIG. 15 is a circuit diagram of a substrate for a print head according to a sixth embodiment of the present invention.
Figure 16:
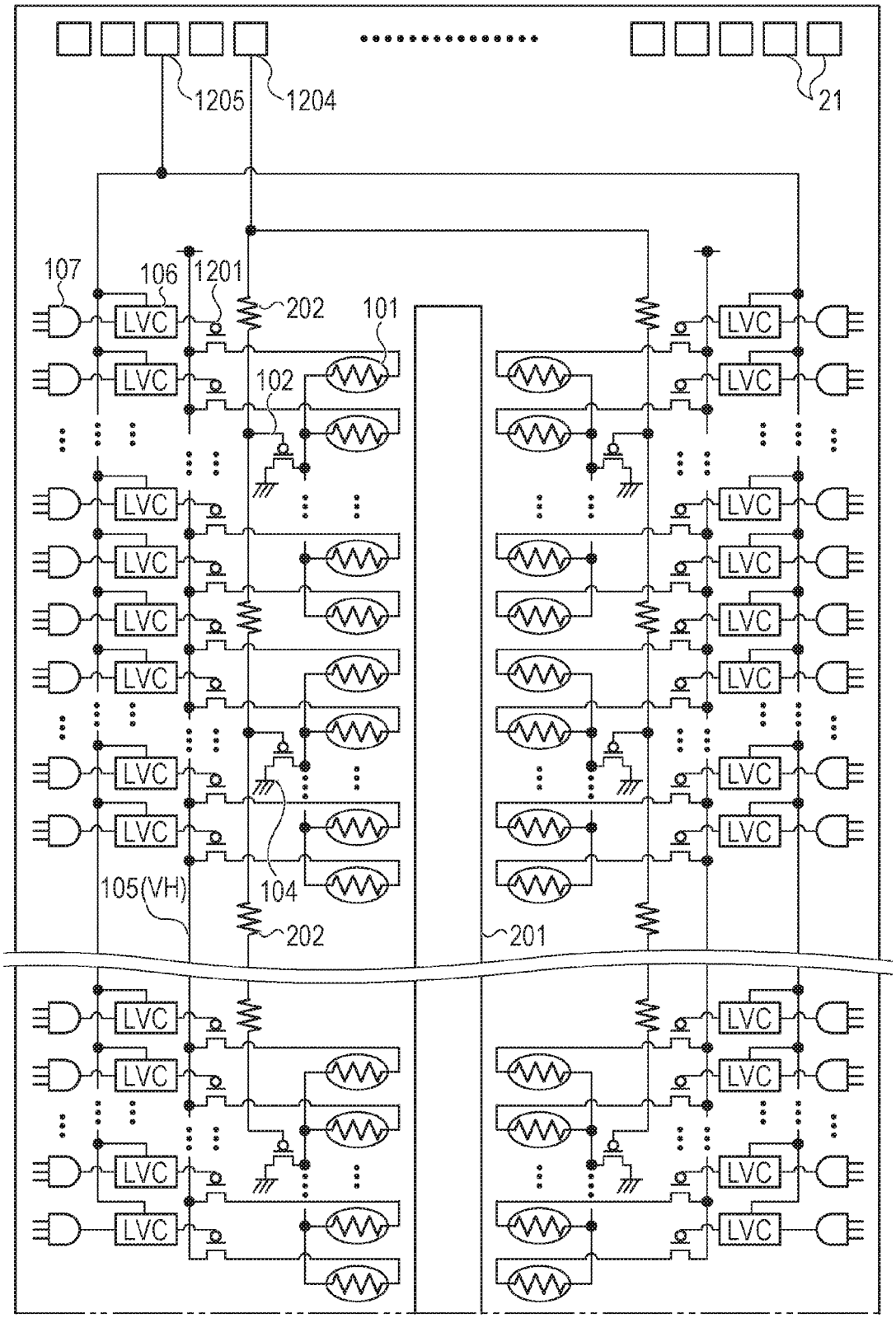
FIG. 16 is a diagram illustrating the arrangement of the components of the circuit in FIG. 15.

FIGS. 15 and 16 are diagrams illustrating a sixth embodiment of the present invention. Descriptions of differences from the fifth embodiment will be given, and descriptions of commonalities will be omitted here.

In this embodiment, as shown in FIGS. 15 and 16, a given voltage VHTH is directly applied to the LVCs 106 via a pad 1205, which is an electrical contact with the outside. Similarly, a given voltage VHTL is directly applied to the gates of the PMOS transistors 102 via a pad 1204, which is an electrical contact with the outside. The voltages have the relation VHTH>VHTL. The second power supply (VH) 105 may be coupled to the pad 21 corresponding to the second power supply 105 via a wiring line (a common wiring line) common to the plurality of PMOS transistors 1201 or via wiring lines (individual wiring lines) for the PMOS transistors 1201 that are turned on at the same time. The relationship between application of the logic supply voltage VDD, the second supply voltage (VH) 105, and the gate supply voltage (VHT) 110 and the sequence of driving is the same as those in FIGS. 3 to 5 in the first embodiment, a description thereof will be omitted.

Other Embodiments

The present invention is applicable to ink-jet printers of various printing systems including not only the serial-scan printing system but also a full-line printing system. The present invention is also applicable to a liquid ejection apparatus that performs various operations including printing and processing on various media (including a sheet) using a liquid ejection head. Another example of the ejection-energy generating element for ejecting liquid is a piezoelectric element in addition to the electro-thermal transducer (the heater).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-068760, filed Mar. 30, 2015, which is hereby incorporated by reference herein in its entirety.

What is claimed is:

1. A substrate for a liquid ejection head capable of ejecting liquid, the substrate being installed in the liquid ejection head and comprising:

at least one liquid-ejection-energy generating element;

first and second connecting units connectable to a first external power supply circuit;

at least one first transistor connected between the first connecting unit and a first end of the liquid-ejection-energy generating element;

at least one second transistor connected between the second connecting unit and a second end of the liquid-ejection-energy generating element;

at least one control circuit configured to control a gate voltage of the first transistor to switch the first transistor; and a supply circuit configured to supply a constant gate voltage to the second transistor to constantly keep the second transistor at ON state, wherein the control circuit controls the first transistor to switch so as to drive the liquid-ejection-energy generating element to an extent that the liquid is not ejected after the first and second connecting units are connected to the external power supply circuit and then the constant gate voltage is applied to the second transistor.

2. The substrate for a liquid ejection head according to claim 1, wherein the control circuit comprises:

a generating unit configured to generate a control signal for switching the first transistor; and a voltage control unit configured to change the gate voltage of the first transistor in response to the control signal.

3. The substrate for a liquid ejection head according to claim 1, the substrate further comprising:

a third connecting unit connectable to a second external power supply circuit, wherein the supply circuit is supplied with the constant gate voltage via the third connecting unit.

4. The substrate for a liquid ejection head according to claim 1, the substrate further comprising:

a fourth connecting unit connectable to a third external power supply circuit;

wherein the supply circuit converts a voltage supplied via the fourth connecting unit to the constant gate voltage.

5. The substrate for a liquid ejection head according to claim 1, wherein the at least one liquid-ejection-energy generating element comprises a plurality of liquid-ejection-energy generating elements, wherein the at least one first transistor comprises a plurality of first transistors in correspondence with the plurality of liquid-ejection-energy generating elements, and wherein the at least one second transistor comprises second transistors less in number than the first transistors and is disposed in common to two or more liquid-ejection-energy generating elements.

6. The substrate for a liquid ejection head according to claim 5, wherein the at least one control circuit comprises a plurality of control circuits in correspondence with the plurality of first transistors, wherein the plurality of liquid-ejection-energy generating elements, the plurality of first transistors, the plurality of second transistors, and the plurality of control circuits are individually arrayed in a first direction, and wherein an array of the liquid-ejection-energy generating elements, an array of the first transistors, an array or the second transistors, and an array of the control circuits are disposed at positions shifted in a second direction intersecting the first direction.

7. The substrate for a liquid ejection head according to claim 6, the substrate further comprising:

a supply port that can communicate with an external liquid supply source, wherein the array of the liquid-ejection-energy generating elements is nearer to the supply port than the array of the first transistors, the array of the second transistors, and the array of the control circuits.

8. The substrate for a liquid ejection head according to claim 5, wherein the plurality of first transistors are connected to the first connecting unit via a first common wiring line, and wherein the plurality of second transistors are connected to the second connecting unit via a second common wiring line.

9. The substrate for a liquid ejection head according to claim 1, wherein the first transistor comprises a common-drain NMOS transistor, and wherein the second transistor comprises a common-drain PMOS transistor.

10. The substrate for a liquid ejection head according to claim 1, wherein the first transistor comprises a common-source NMOS transistor, and wherein the second transistor comprises a common-drain NMOS transistor.

11. The substrate for a liquid ejection head according to claim 1, wherein the first transistor comprises a common-source PMOS transistor, and wherein the second transistor comprises a common-drain PMOS transistor.

12. A liquid ejection head comprising:

a substrate installed in the liquid ejection head and comprising:

at least one liquid-ejection-energy generating element;

first and second connecting units connectable to a first external power supply circuit;

at least one first transistor connected between the first connecting unit and a first end of the liquid-ejection-energy generating element;

at least one second transistor connected between the second connecting unit and a second end of the liquid-ejection-energy generating element;

at least one control circuit configured to control a gate voltage of the first transistor to switch the first transistor; and a supply circuit configured to supply a constant gate voltage to the second transistor to constantly keep the second transistor at ON state, wherein the control circuit controls the first transistor to switch so as to drive the liquid-ejection-energy generating element to an extent that the liquid is not ejected after the first and second connecting units are connected to the external power supply circuit and then the constant gate voltage is applied to the second transistor.

13. A liquid ejection apparatus comprising:

a liquid ejection head; and a control unit configured to control the liquid ejection head to eject the liquid supplied to the liquid ejection head, wherein the liquid ejection head comprises:

at least one liquid-ejection-energy generating element;

first and second connecting units connectable to a first external power supply circuit;

at least one first transistor connected between the first connecting unit and a first end of the liquid-ejection-energy generating element;

at least one second transistor connected between the second connecting unit and a second end of the liquid-ejection-energy generating element;

at least one control circuit configured to control a gate voltage of the first transistor to switch the first transistor; and a supply circuit configured to supply a constant gate voltage to the second transistor to constantly keep the second transistor at ON state, wherein the control circuit controls the first transistor to switch so as to drive the liquid-ejection-energy generating element to an extent that the liquid is not ejected after the first and second connecting units are connected to the external power supply circuit and then the constant gate voltage is applied to the second transistor.

14. The liquid ejection apparatus according to claim 13, wherein the control unit controls the first transistor to switch via the control circuit.

15. The liquid ejection apparatus according to claim 14, wherein the control unit controls the liquid-ejection-energy generating element to be driven for a short time so that the liquid is not ejected.

16. A method for ejecting liquid from a liquid ejection head comprising at least one liquid-ejection-energy generating element configured to generate energy for ejecting liquid, the method comprising:

a step of preparing a liquid ejection head comprising:

at least one first transistor connected to a first end of the ejection-energy generating element;

at least one second transistor connected to a second end of the ejection-energy generating element;

at least one control circuit configured to control a gate voltage of the first transistor to switch the first transistor; and a supply circuit configured to supply a gate voltage to the second transistor to turn on the second transistor;

a non-ejecting step of switching the first transistor via the control circuit, after the gate voltage is supplied to the second transistor, so as to drive the ejection-energy generating element to extent that the liquid is not ejected; and an ejecting step of switching the first transistor via the control circuit, after the non-ejecting process, so as to drive the ejection-energy generating element to eject the liquid.

17. The method for ejecting liquid according to claim 16, wherein the control circuit comprises:

a generating unit configured to generate a control signal for switching the first transistor; and a voltage control unit configured to change the gate voltage of the first transistor in response to the control signal.

18. The method for ejecting liquid according to claim 16, wherein the at least liquid-ejection-energy generating element comprises a plurality of liquid-ejection-energy generating elements, wherein the at least one first transistor comprises a plurality of first transistors in correspondence with the plurality of liquid-ejection-energy generating elements, and wherein the at least one second transistor comprises second transistors less in number than the first transistors and is disposed in common to two or more liquid-ejection-energy generating elements.

19. The method for ejecting liquid according to claim 18, wherein the at least one control circuit comprises a plurality of control circuits in correspondence with the plurality of first transistors, wherein the plurality of liquid-ejection-energy generating elements, the plurality of first transistors, the plurality of second transistors, and the plurality of control circuits are individually arrayed in a first direction, and wherein an array of the liquid-ejection-energy generating elements, an array of the first transistors, an array of the second transistors, and an array of the control circuits are disposed at positions shifted in a second direction intersecting the first direction.

* * * * *